US008770780B1

(12) United States Patent
Jang et al.

(10) Patent No.: US 8,770,780 B1
(45) Date of Patent: Jul. 8, 2014

(54) DISPLAY AND ILLUMINATION UNITS USED AS PART OF A BUILDING

(71) Applicants: Tyson E. Jang, Seoul (KR); Sei-Joo Jang, Bellefonte, PA (US)

(72) Inventors: Tyson E. Jang, Seoul (KR); Sei-Joo Jang, Bellefonte, PA (US)

( * ) Notice: Subject to any disclaimer, the term of this patent is extended or adjusted under 35 U.S.C. 154(b) by 44 days.

(21) Appl. No.: 13/677,790

(22) Filed: Nov. 15, 2012

(51) Int. Cl.
*F21S 8/00* (2006.01)

(52) U.S. Cl.
USPC ..... 362/147; 362/145; 362/148

(58) Field of Classification Search
None
See application file for complete search history.

(56) References Cited

U.S. PATENT DOCUMENTS

| | | | | |
|---|---|---|---|---|
| 5,083,251 | A * | 1/1992 | Parker | 362/255 |
| 5,989,283 | A * | 11/1999 | Wilkens | 607/88 |
| 6,827,473 | B2 * | 12/2004 | Kobayashi | 362/510 |
| 8,385,735 | B2 * | 2/2013 | Awazu | 396/236 |

* cited by examiner

*Primary Examiner* — Natalie Walford
(74) *Attorney, Agent, or Firm* — John J. Elnitski, Jr.

(57) ABSTRACT

A building block having at least one shape in the building block which includes a sealed volume surrounded by the shape, where the shape includes a transparent front and transparent rear to allow light to pass through the front and the rear and enter into a building partially or fully covered by the building block. There is at least one iris aperture diaphragm on the rear of each of at least one shape which is positioned to let all light pass into the building, each of the at least one iris aperture diaphragm having an adjustable opening to control how much light passes into the building.

15 Claims, 27 Drawing Sheets

DISPLAY AND ILLUMINATION UNITS USED AS PART OF A BUILDING

BACKGROUND

The present invention relates generally to the field of building materials for the construction of buildings. More specifically, the present invention relates to building materials that also act as a display and allow light to enter a building.

Most of the billboard size displays are used along busy highways. Large LCD display panels installed on the walls of buildings are now used for advertisement in cities. These large LCD panels are quite expensive to install and maintain, while also consuming large amounts of electric energy during operation. There are large populations living and working in major cities with many large tall buildings. The walls and ceilings of buildings are usually constructed by using opaque materials and windows. Illumination of the outside and inside of the building and heating/cooling of the building are necessary functions for people working and living at the building.

Saving energy is a very important task worldwide recently due to rapidly increasing greenhouse gas emissions in every day human activity. If a way of saving energy during illumination and heating/cooling of buildings can be found, then it would contribute to slowing down the deterioration of environment by reducing greenhouse gas emissions. Radiation from the sun is an abundant energy source available to us all year long. It would be a significant achievement to find ways of utilizing sun light for the display and illumination as a part of buildings.

It is an object of the present invention to provide a multifunctional structure as part of a building for display purposes and for illumination purposes.

SUMMARY OF INVENTION

A building block having at least one shape in the building block which includes a sealed volume surrounded by the shape, where the shape includes a transparent front and transparent rear to allow light to pass through the front and the rear and enter into a building partially or fully covered by the building block. There is at least one iris aperture diaphragm on the rear of each of at least one shape which is positioned to let all light pass into the building, each of the at least one iris aperture diaphragm having an adjustable opening to control how much light passes into the building.

DETAILED DESCRIPTION OF THE INVENTION

The present invention is the use of display units and illumination units as building blocks for the construction of buildings. These building blocks can be used as part of the structural support of the building or merely be the facade of the building.

Figure 1:
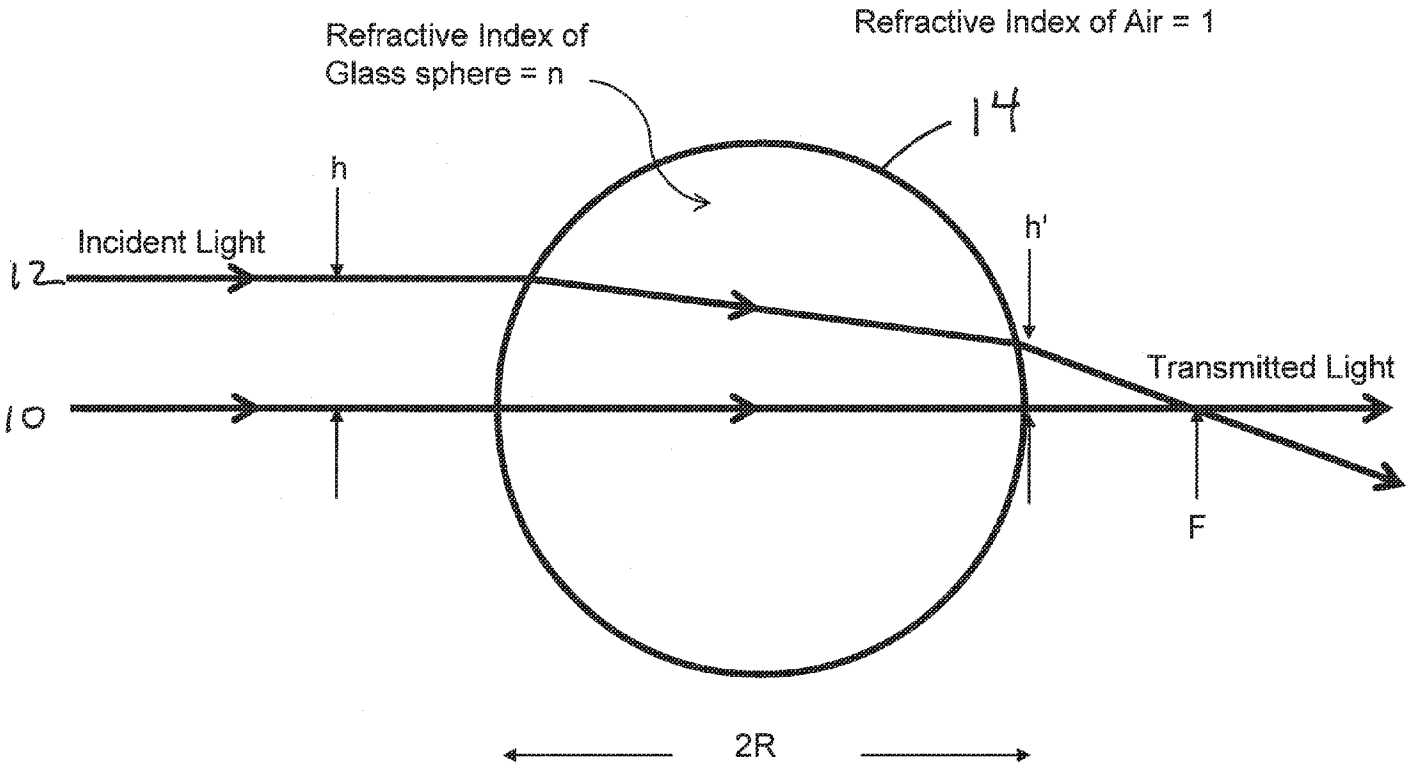
FIG. 1 is a schematic of light through a transparent shape according to the present invention.

FIG. 1 shows a path of parallel light rays 10, 12 of a light beam as they pass through an optically transparent shape shown as a sphere 14 made from an optically transparent material such as glass, where the sphere 14 has a refractive index of (n). Ray 10 does not deviate from its path through the center of the sphere 14. Ray 12 at a distance (h) from ray 10 passes through the sphere 14 and is refracted by angle of (h/R), for (h/R)<<1. Where (h) is distance between the rays 10, 12 and R is the radius of the sphere. Ray 12 exits the rear surface of the sphere at distance (h') from where ray 10 exits the sphere. This relationship can be expressed as, $$(h')=(h)\{(2/n)-1\} \tag{1}$$

Figure 2:
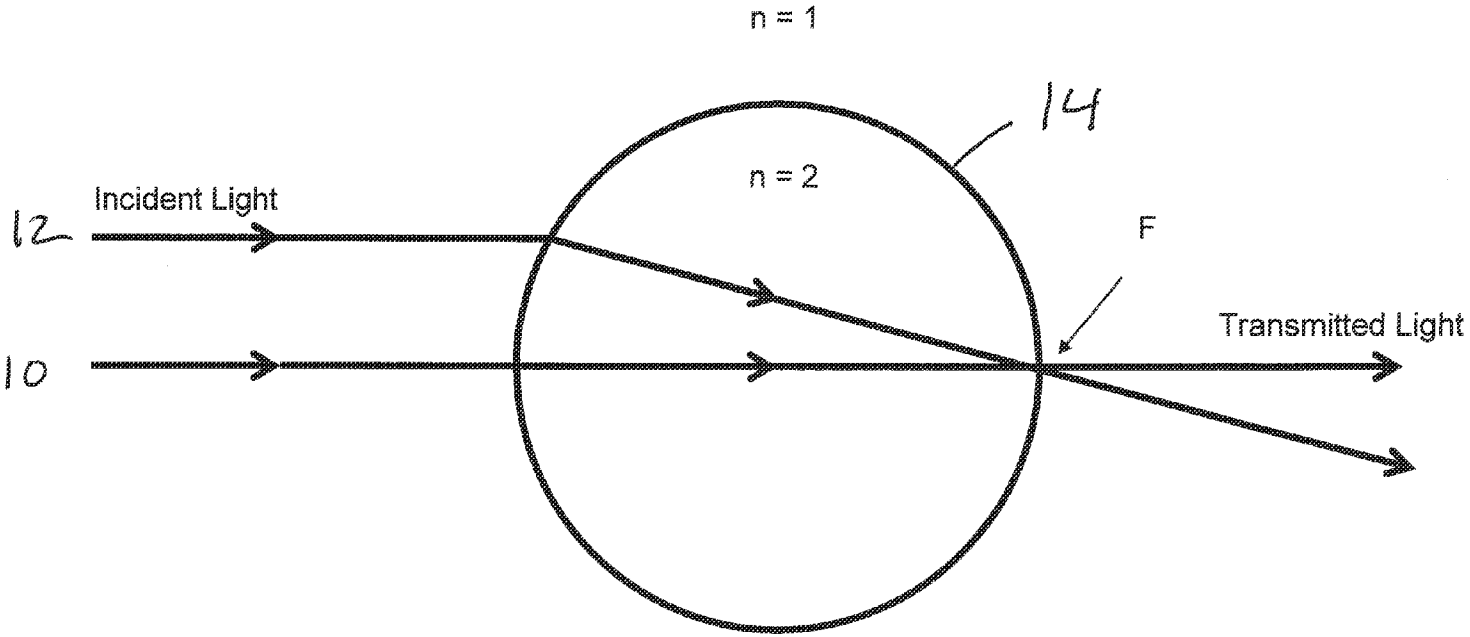
FIG. 2 is a schematic of light through a transparent shape according to the present invention.

(h') in equation 1 is a radius (r) of circular area covered by the light beam of rays at back of sphere 14. The principles of the above effects are well described in reference, "WAVES", Berkeley physics course, vol. 3, Chapter 9, by F. S. Crawford, Jr., McGraw-Hill Book Company, 1968. FIG. 2 shows the path of a ray 12 parallel to ray 10, which enters the sphere 14 at a distance (h) from ray 10. The sphere 14 has a refractive index of n=2. Note that the (h') becomes zero where ray 16 exits the sphere 14, so all rays of the light beam passing through the sphere 14 are arriving at the focal point (F), according to equation (1).

Figure 3:
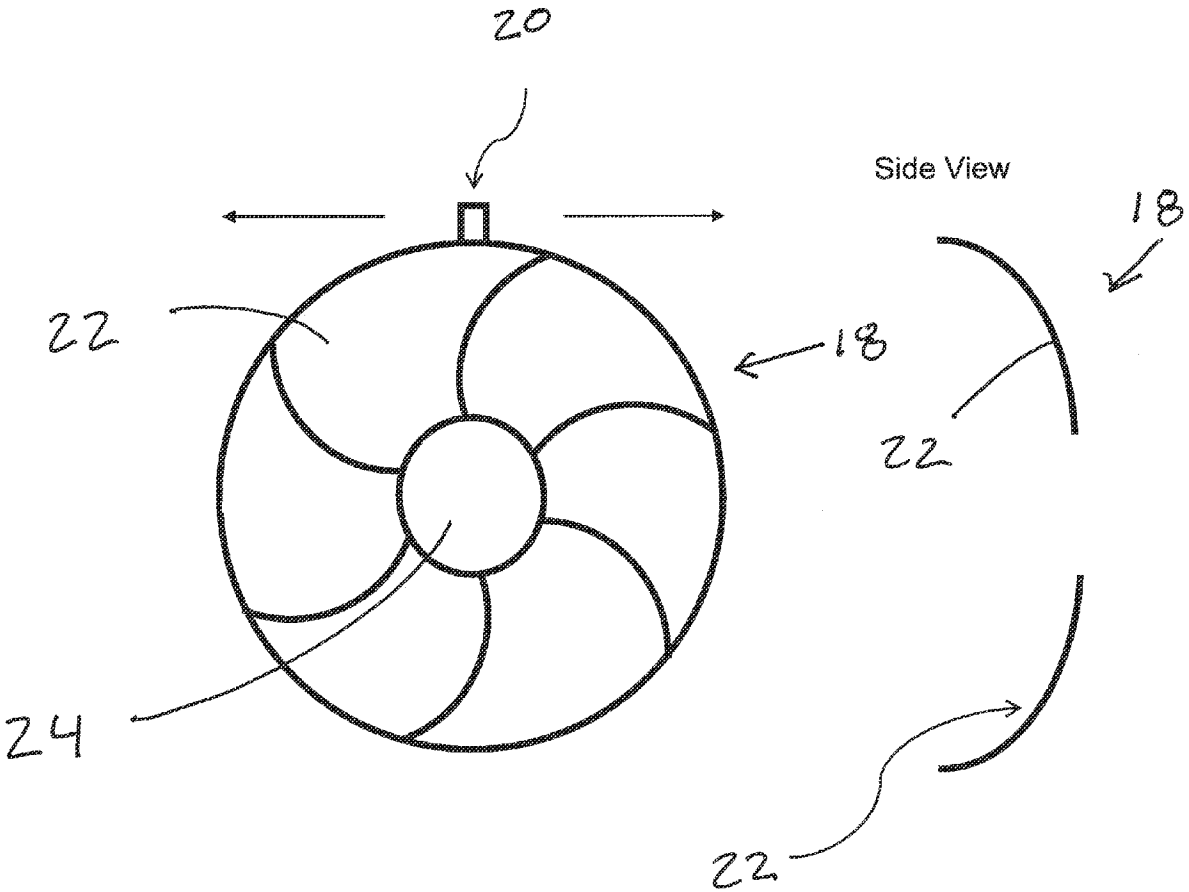
FIG. 3 is a schematic of a concave aperture iris diaphragm according to the present invention.
Figure 4:
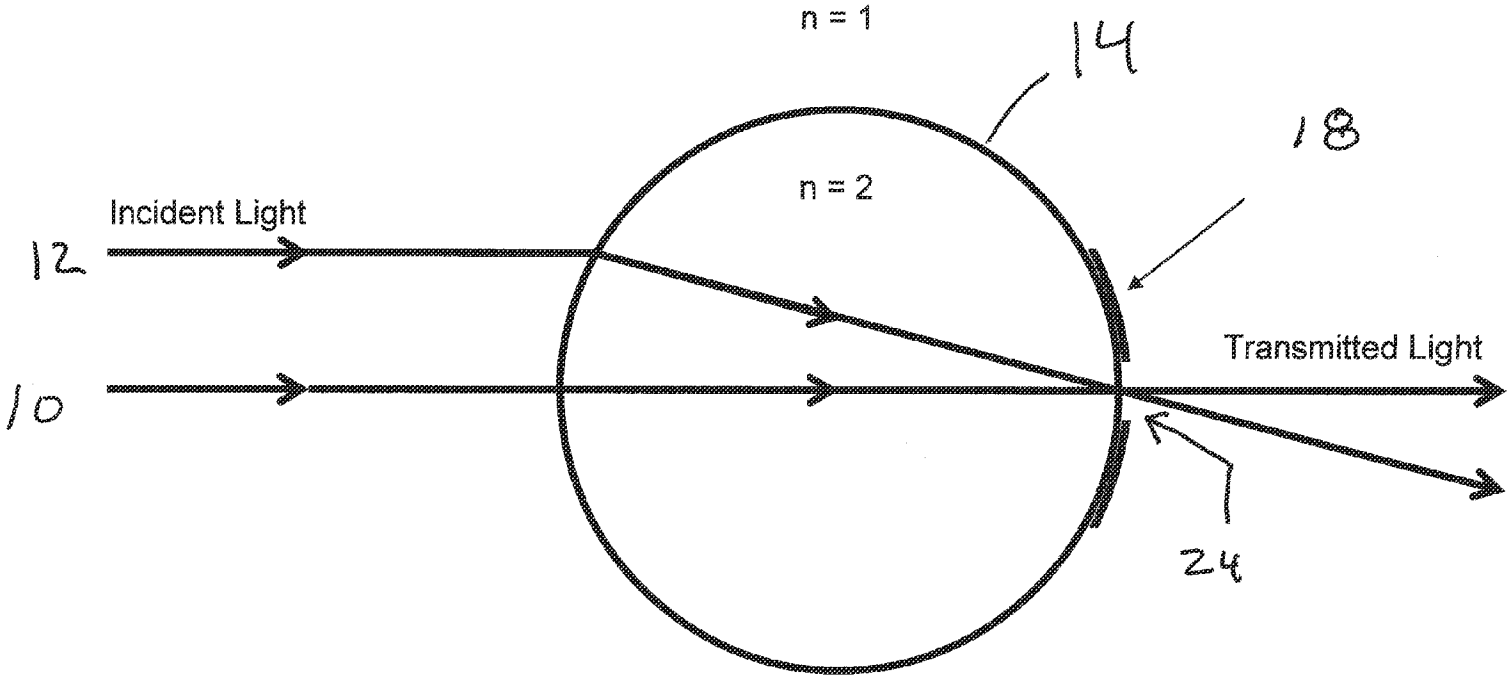
FIG. 4 is a schematic of light through a transparent shape according to the present invention.
Figure 5:
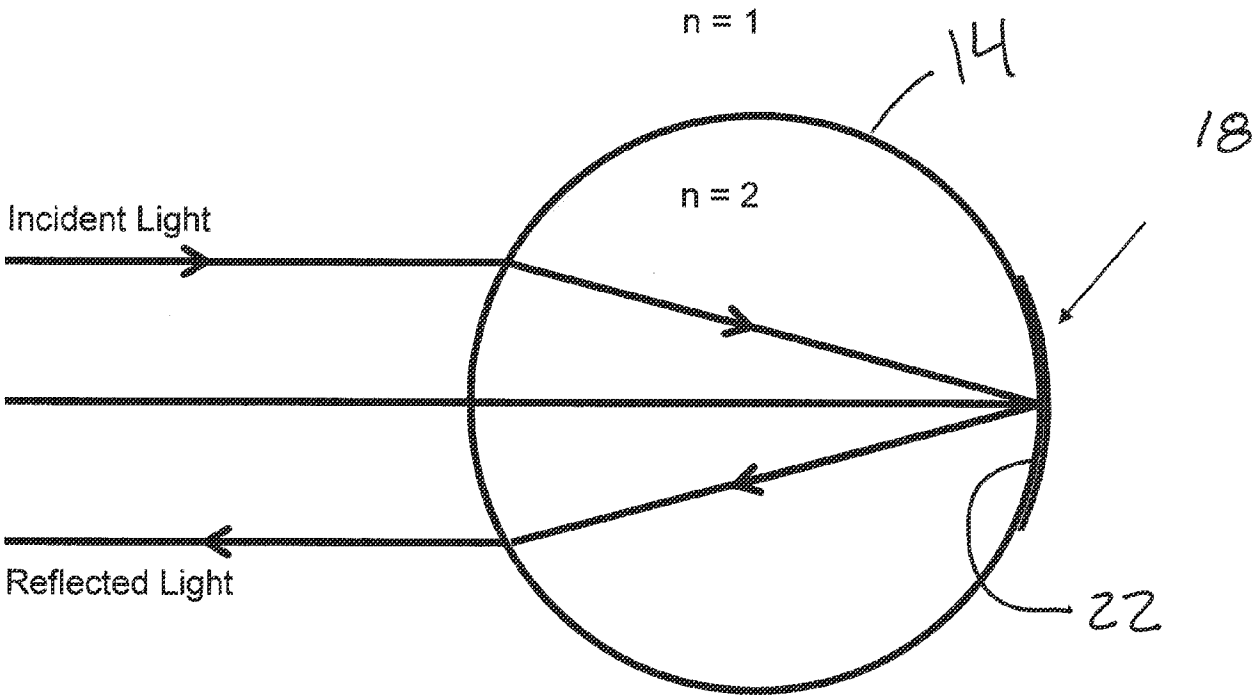
FIG. 5 is a schematic of light through a transparent shape according to the present invention.
Figure 6:
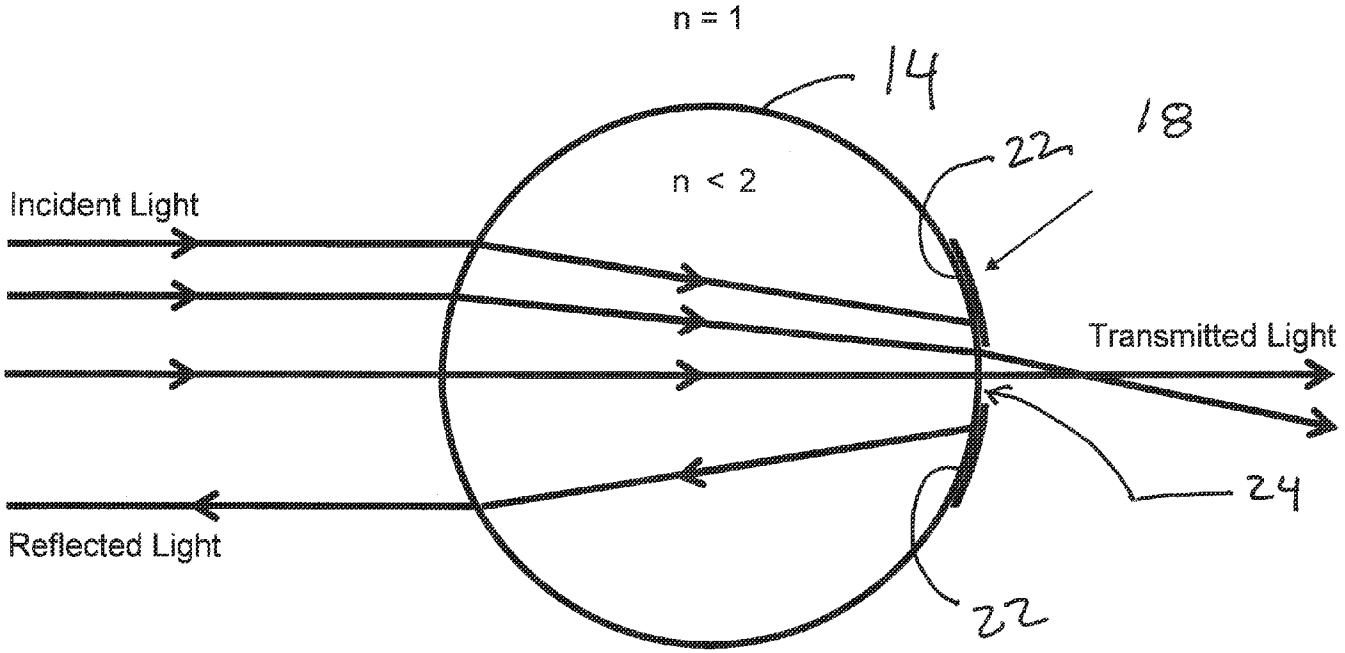
FIG. 6 is a schematic of light through a transparent shape according to the present invention.

FIG. 3 is an example of partially open concave aperture iris diaphragm 18 with an operation control knob 20. The front surface 22 is silvery mirror shape for full reflection to incoming light beams. FIG. 4 shows the path of ray 12 with the fully open concave aperture iris diaphragm 18 located at focal point area of sphere 14, where the rays of the light beam exit. Note, that the incoming rays are passing through the sphere 14 and an opening 24 in the concave aperture iris diaphragm 18. The radius of the fully open concave aperture iris diaphragm 18 should be larger than (h'), which is a radius of the light beam at the focal point area. For the sphere 14 of an index of n<2, the radius would be greater than "zero" in theory according to equation (1). The incoming light beam could be natural sun light or produced light such as LED lighting. The transmitted incoming light beam of rays can be utilized for illuminating the area on the other side of sphere 14 where the light beam of rays exit, for an example, the interior of a building. FIG. 5 shows the path of parallel rays of a light beam with the closed concave aperture iris diaphragm 18 located at focal point area of sphere. The incoming light beam is fully reflected and directed back to the direction of incoming light beam. The front surface 22 of concave aperture iris diaphragm 18 is silvery mirror shape to fully reflect the incoming light beam. FIG. 6 shows the path of rays of a parallel light beam passing through the sphere 14 of which refractive index is a little smaller than "2" and with a partially open concave aperture iris diaphragm 18 located at focal point area of the sphere 14. The light beam size at the concave aperture iris diaphragm 18 will be determined by the refractive index and the size of sphere 14 for given incoming light beam. Further, the refractive index, (n), of the sphere 14 can be adjusted by choosing the proper transparent material to make the sphere 14. The light beam size at the concave aperture iris diaphragm 18 becomes bigger as the refractive index becomes smaller than "2", according to equation (1). For example, it would be larger beam radius(r) for the sphere 14 having a refractive index equal to "1.9" than that of a refractive index equal to "2". FIG. 6 shows the light beam partially transmitted from the incoming light source which can be utilized for illuminating beyond the exit side of sphere 14, such as the interior of a building. This means that closing the aperture opening 24 of concave aperture iris diaphragm 18 prevents light from entering the building.

The combination of the transparent shape of the sphere 14 and the concave aperture iris diaphragm 18 as an illumination unit in a building block can be used as a material to build a building and/or its facade to allow light to illuminate the inside of the building. The illuminating of the inside of a building can be pre-set and controlled automatically in real time by adjusting the opening 24 of the concave aperture iris diaphragm 18 located at focal point area behind sphere 14 for a given incoming light source. The illumination unit can also be used to fully reflect incoming light away from the building by fully closing aperture opening 24 of concave aperture iris diaphragm 18.

Figure 7:
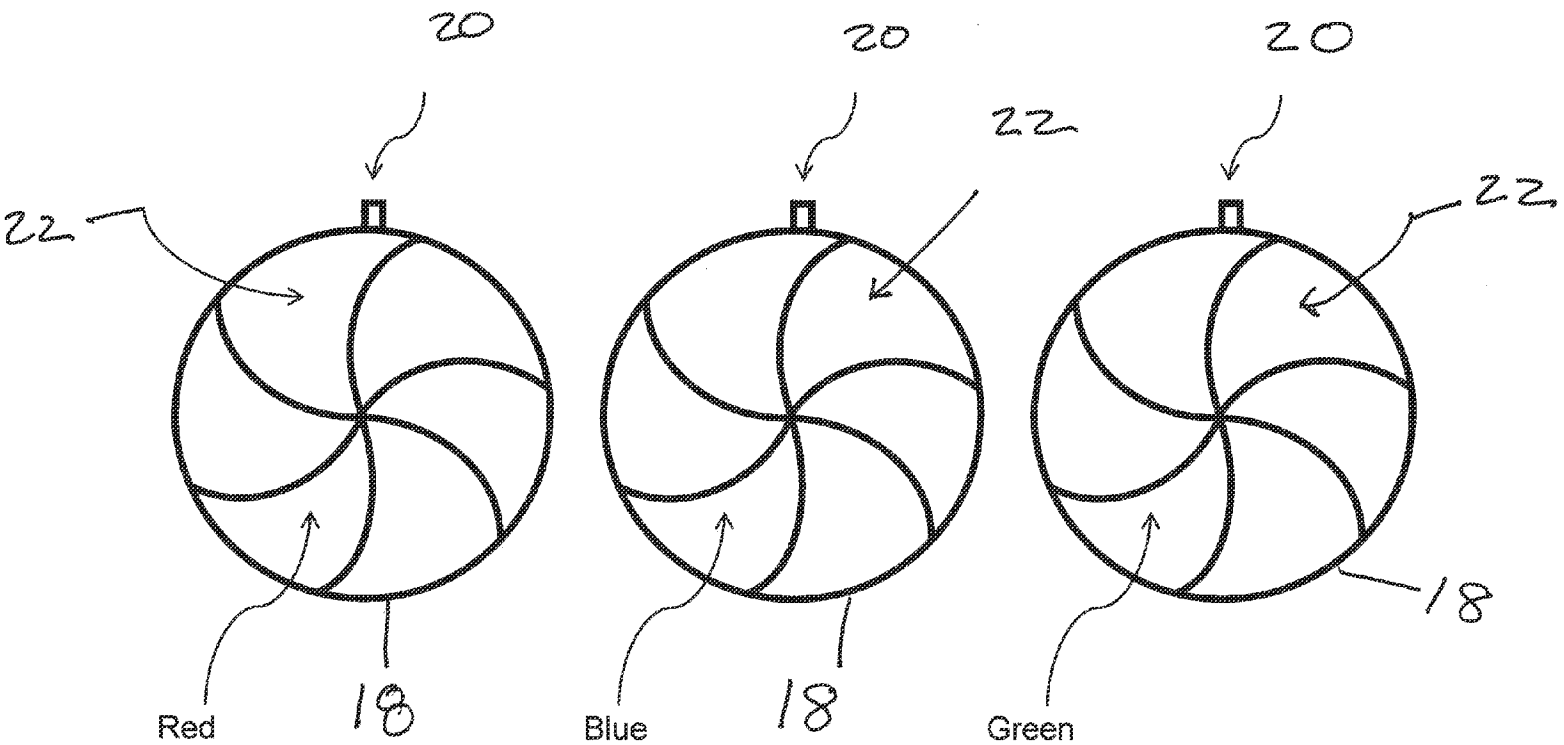
FIG. 7 is a schematic of concave aperture iris diaphragms according to the present invention.
Figure 8:
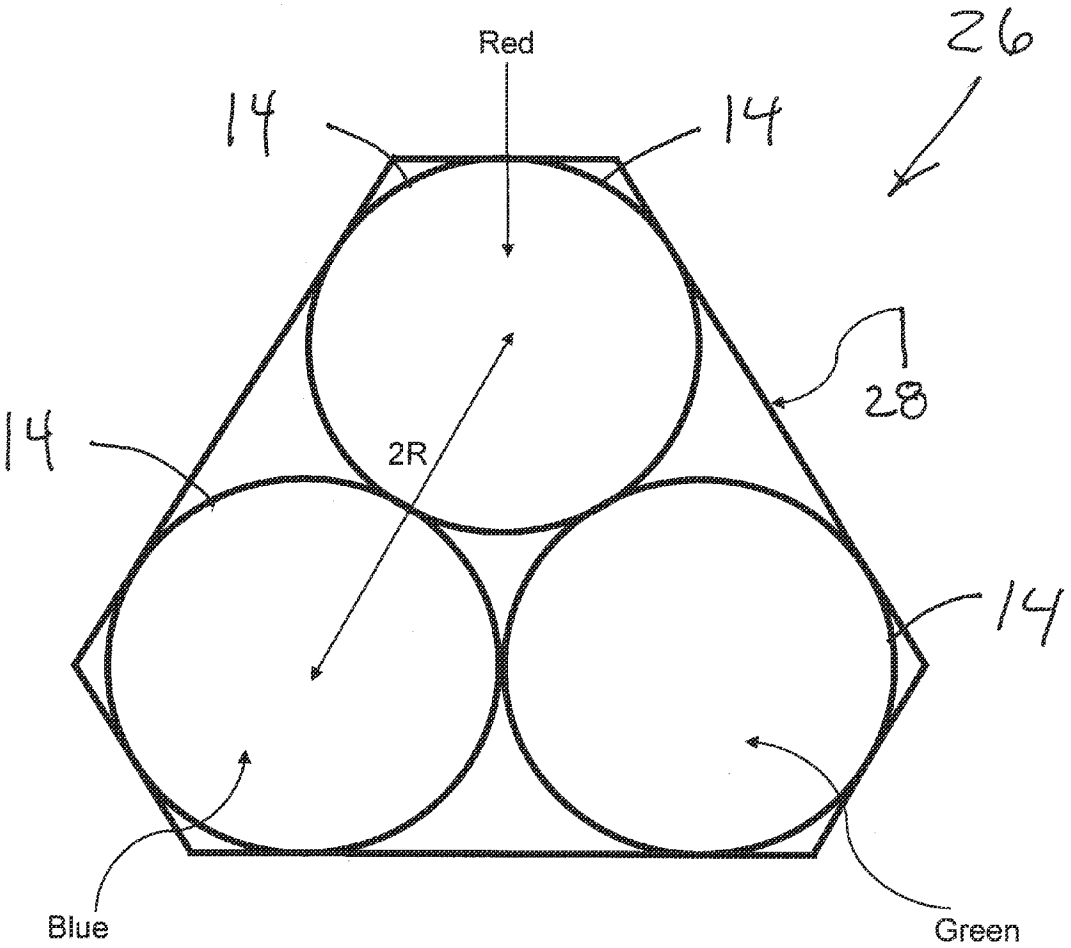
FIG. 8 is a schematic of a display unit according to the present invention.

FIG. 7 shows three concave aperture iris diaphragms 18 having the reflecting surfaces 22 painted with the three primary colors of red, green, and blue in a reflective paint. The reflecting surfaces 22 are mirror like and shaped for full reflection of the incoming light beam. The primary three colored coatings are painted on top of the full reflected front surfaces 22 of three concave aperture iris diaphragms 18. The opening 24 of concave aperture iris diaphragm 18 can be adjusted by the operation control knob 20 located at designed position, as shown in FIG. 7. The intensity of reflected colored light beam would be controlled by adjusting the opening 24 size of concave aperture iris diaphragms 18. FIG. 8 shows a display unit 26 used to form a display as part of a building. The display unit 26 includes three spheres 14 acting as transparent shapes with the three primary colored of reflecting concave aperture iris diaphragms 18 of red, green, and blue. The display unit 26 of three spheres 14 can be assembled within a unit box 28 that is formed around the three spheres 18 to make a brick like building material for use as part of the structure of a building. The radius of spheres 14 can be chosen to form the unit box size, where suggested diameters of the spheres 14 can be from 1 Cm to $1\times10^2$ Cm. The illumination units can be combined in a unit box 28 appropriate to the number of spheres 14 used in the unit box 28 for the display unit 16.

Figure 9:
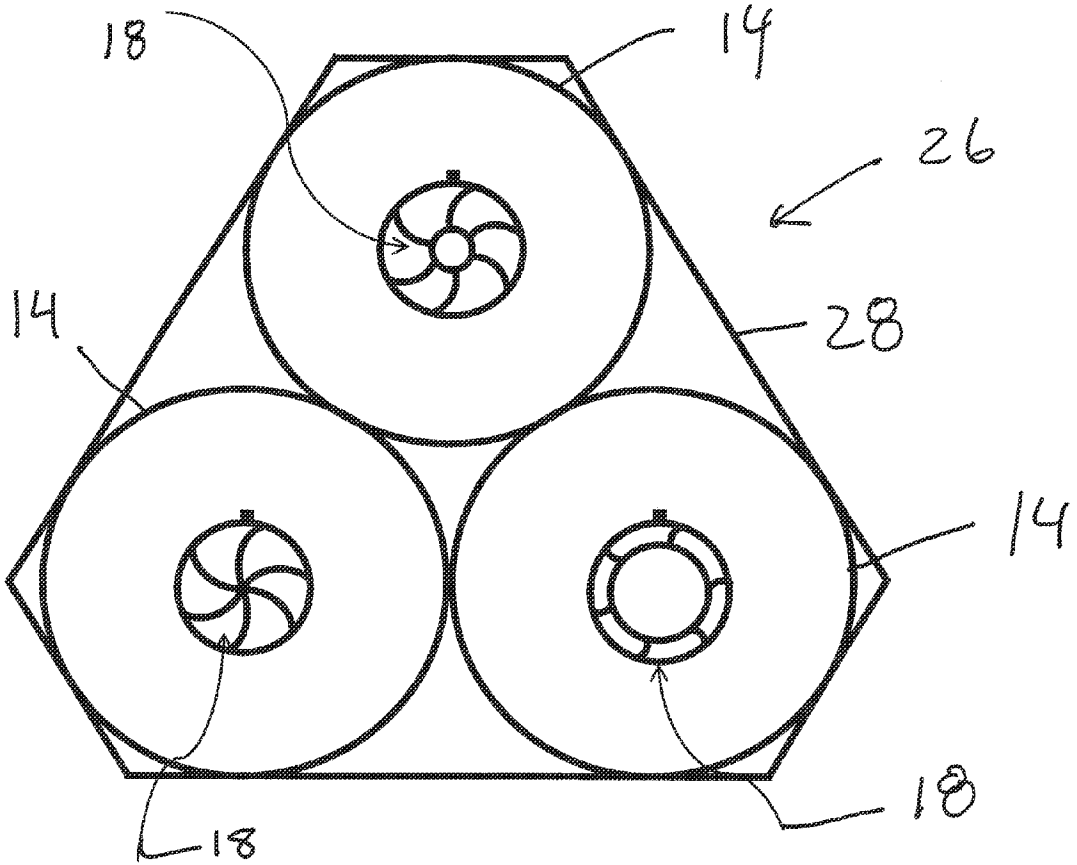
FIG. 9 is a schematic of a display unit according to the present invention.
Figure 10:
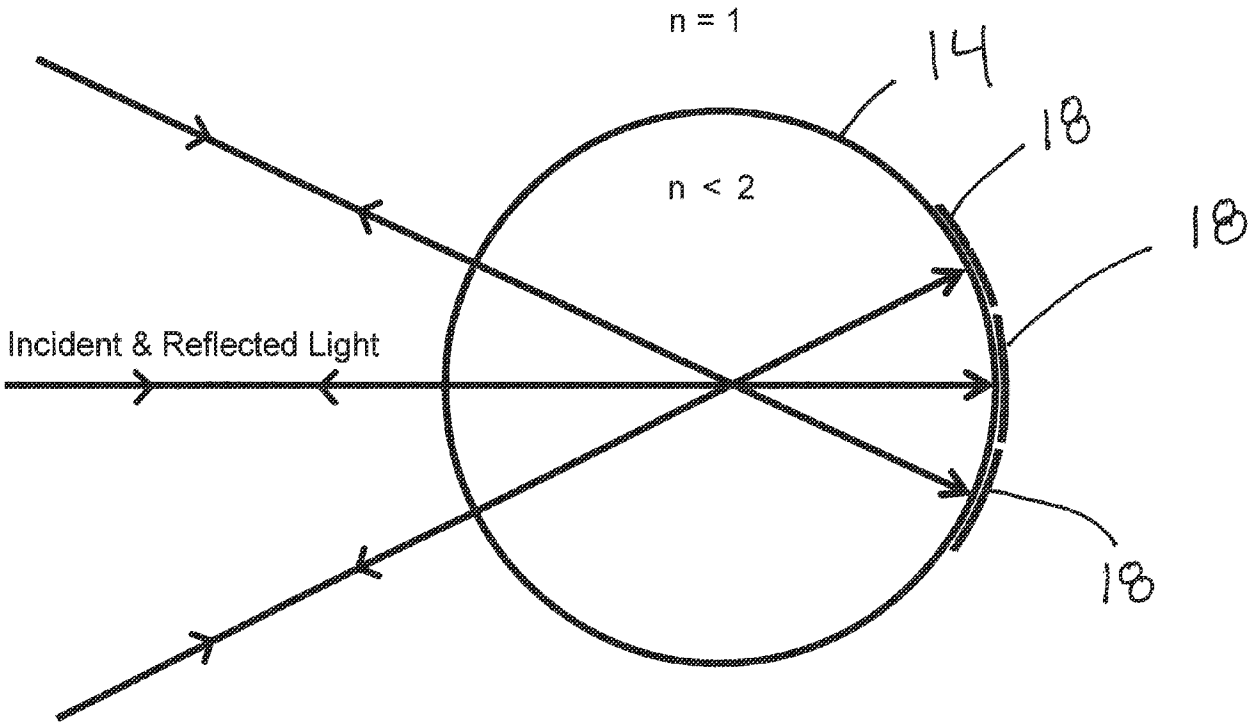
FIG. 10 is a schematic of light through a transparent shape according to the present invention.
Figure 11:
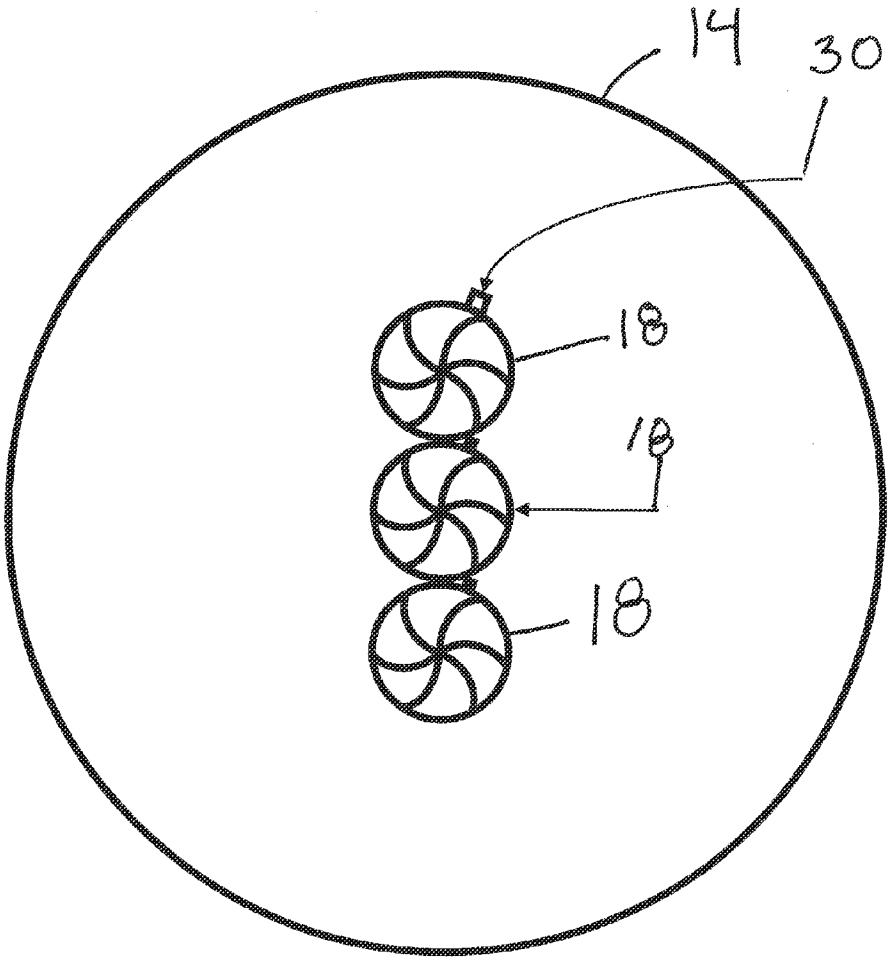
FIG. 11 is a schematic of concave aperture iris diaphragms on a transparent shape according to the present invention.

FIG. 9 shows the rear view of the display unit 26 of FIG. 8. The primary colored reflecting concave aperture iris diaphragms 18 are located at the focal point area of each sphere 14. The radius of concave aperture iris diaphragm 18 is determined depending on the refractive index of the sphere 14. It should be larger than (h') of equation (1). FIG. 10 shows the path of rays of light beams entering the sphere 14 at three different angles and shows three concave aperture iris diaphragms 18 located at the corresponding focal point areas of sphere 14 for each ray. FIG. 11 shows the rear view of the sphere 14 of FIG. 10 with the three reflecting concave aperture iris diaphragms 18 located at focal point areas for the rays of the three light beams which enter the sphere 14 at different angles. FIG. 11 represents the corresponding iris aperture diaphragms 18 locations at near focal point areas for rays of FIG. 10. Note, that three aperture iris diaphragms 18 can be controlled by the master knob 30 that can control all three aperture iris diaphragms 18 or control the aperture iris diaphragms 18 individually.

Figure 12:
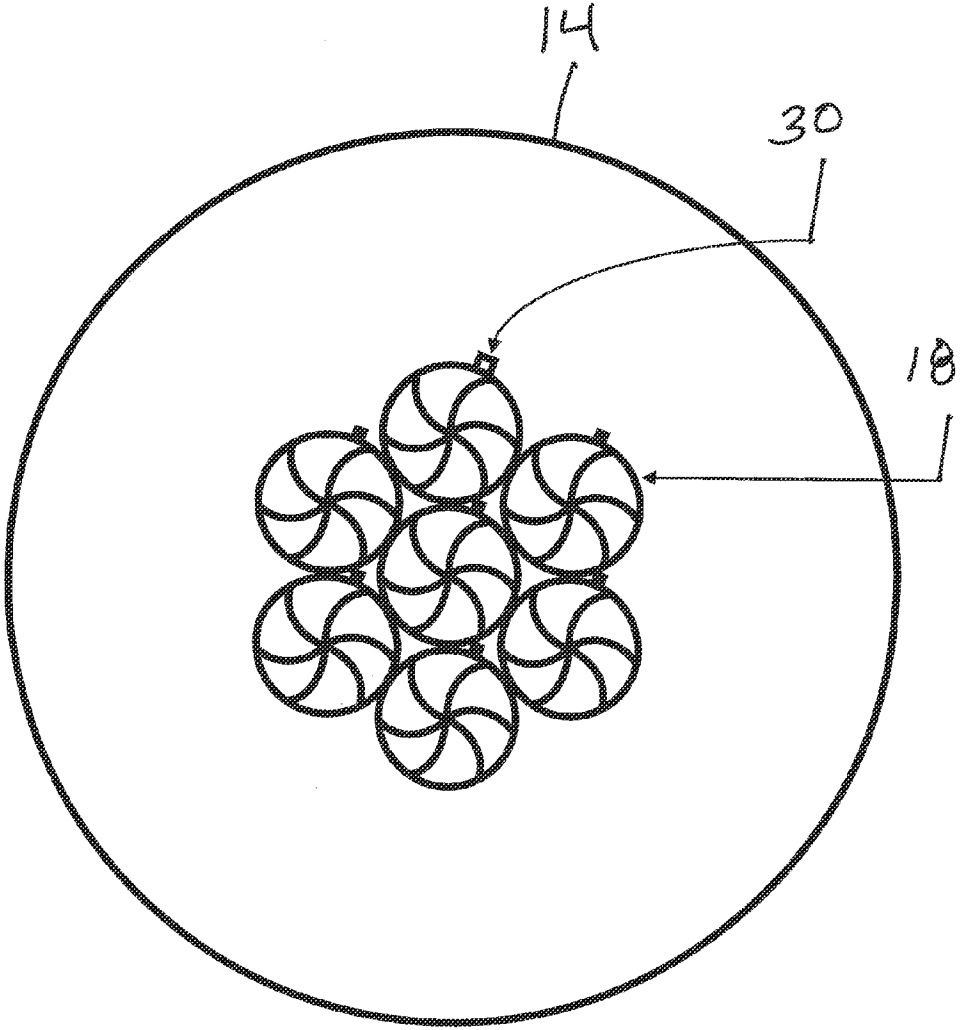
FIG. 12 is a schematic of concave aperture iris diaphragms on a transparent shape according to the present invention.
Figure 13:
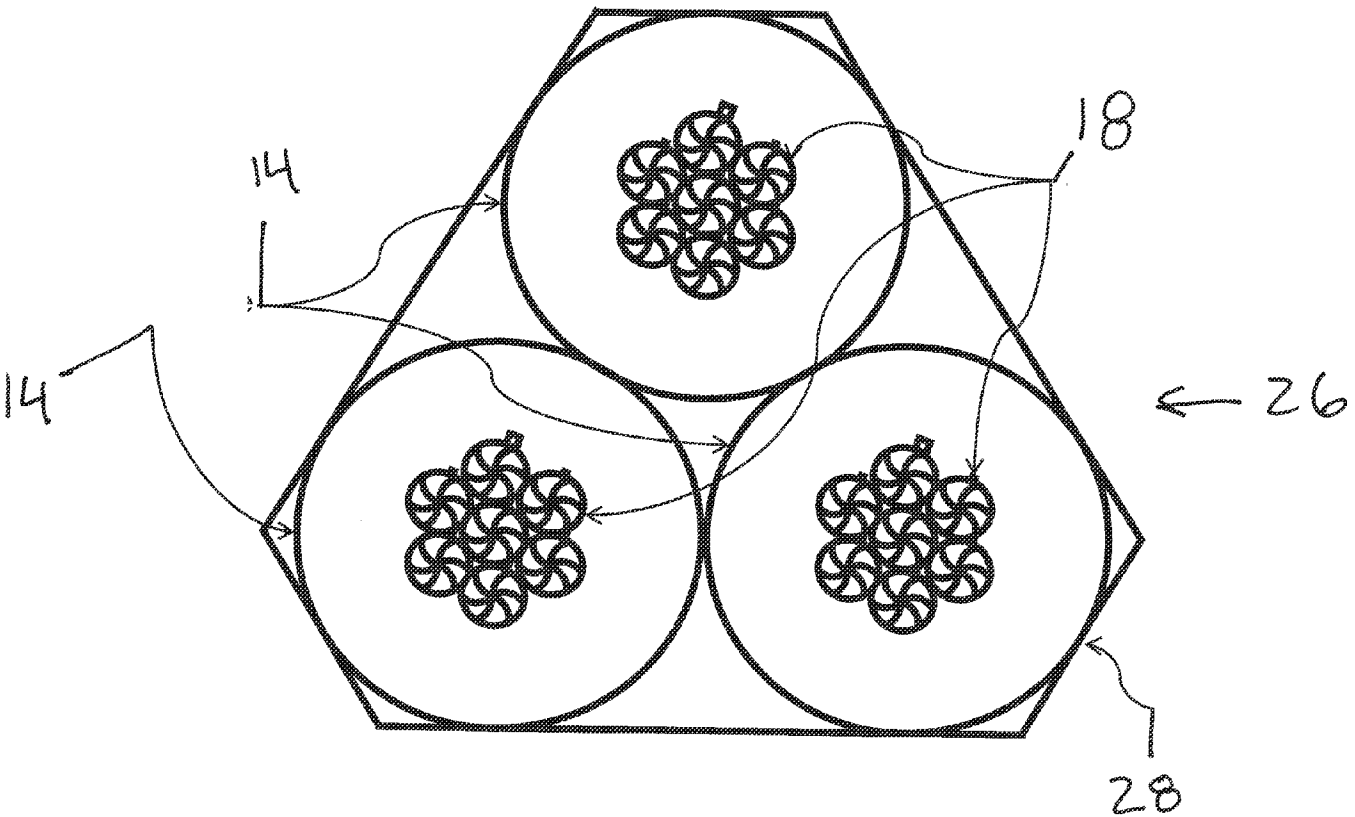
FIG. 13 is a schematic of concave aperture iris diaphragms on a transparent shape according to the present invention.
Figure 14:
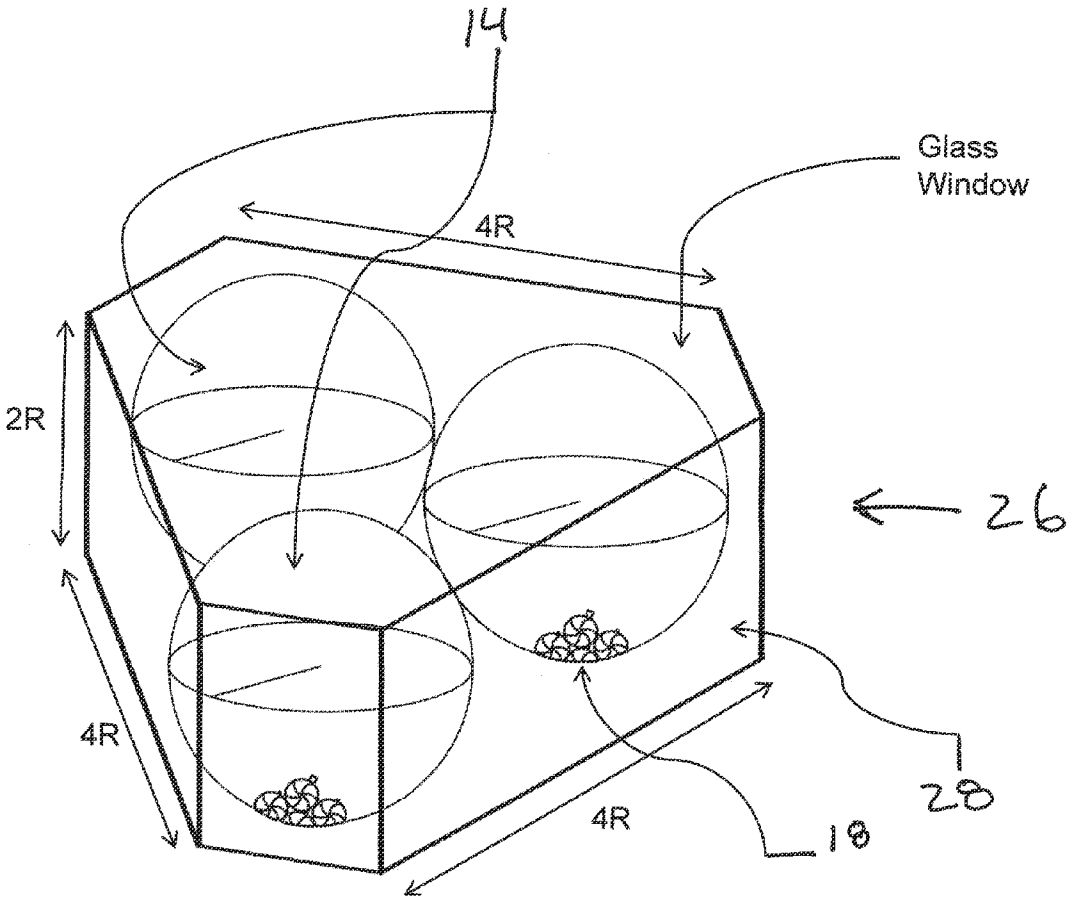
FIG. 14 is a schematic of a display unit according to the present invention.
Figure 15:
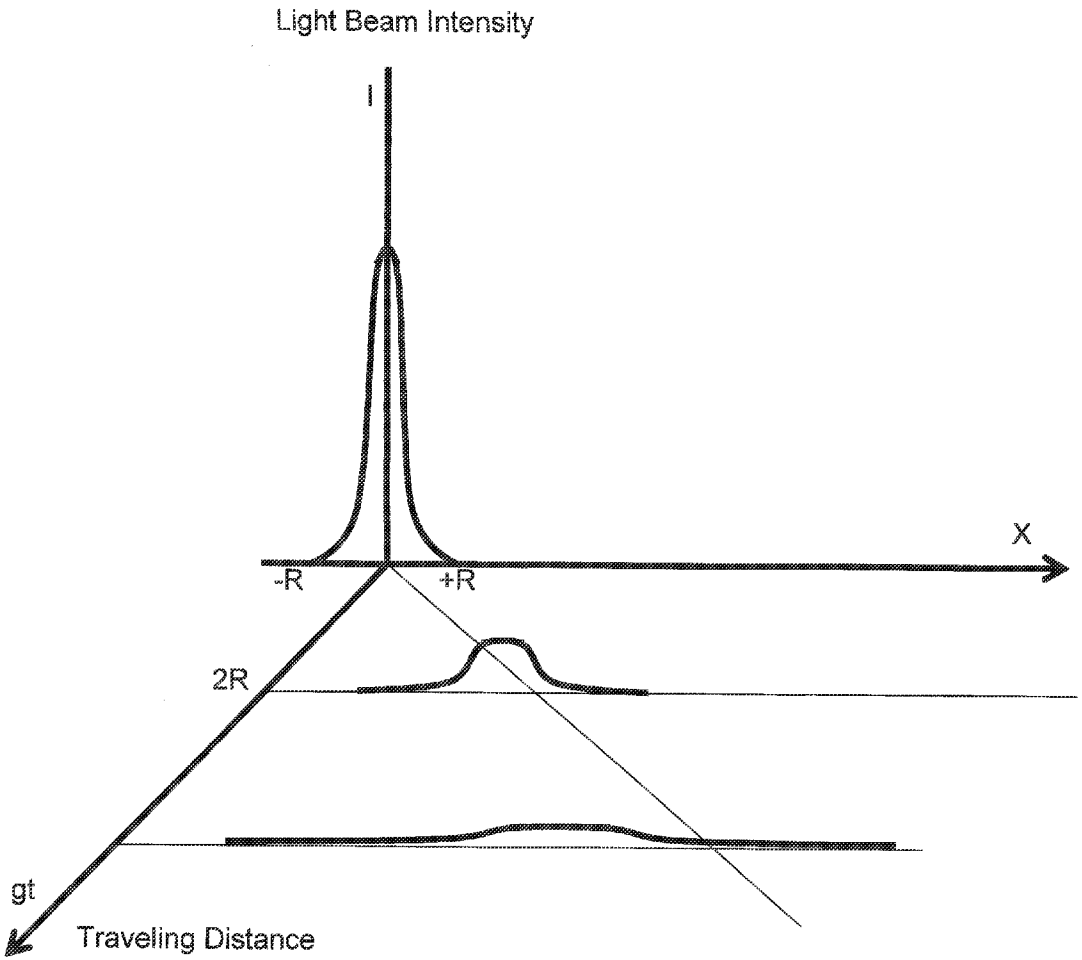
FIG. 15 is a graph of light beam intensity vs. travel distance according to the present invention.

FIG. 12 shows the rear view of a sphere 14 that has seven reflecting concave aperture iris diaphragms 18 located at focal point areas to receive seven different light beams which emanate from different angles. In real situations, the incident light beam enters each sphere 14 from a wide space angle. So, the reflected light beam will also be seen from the different angles. Consequently, the display information would be delivered to the wide space angle. In other words, the reflected colors to be referred to as display information could be observed while walking or driving by the display unit 26 from the distance further than "2R", as shown in FIG. 15. By installing the reflective aperture iris diaphragms 18 at the corresponding focal points of the sphere 14, as shown in FIG. 12, a wide angle display panel could be constructed of multiple display units 26. The seven aperture iris diaphragms 18 can be adjusted by the master control knob 30. FIG. 13 shows the rear view of a display unit 26 with three spheres 14 shown in FIG. 12. Each sphere 14 having the primary colors reflecting concave aperture iris diaphragms 18 located at focal point areas about the rear of each sphere 14. The display unit 26 can be used as the building block or facade for the walls and ceilings of building and using a multiple of them together form a display. FIG. 14 represents an assembled display unit 26 in the unit box 28. It can be used like a brick for construction of the building. The front surface of the unit box 28 can be covered by the transparent panel.

FIG. 15 shows the change in shape of a traveling reflected light beam as it travels along toward a detector, i.e., eyes of person for an instance. The traveling distance is represented as (g×t), where (g) is a speed of light beam and (t) is the traveling time. And the (I) is the intensity of light beam. From the distance further than "2R", the shape of a traveling reflected light beam is spread out quite significantly. The dispersion of a traveling light beam in a dispersive medium has been studied well. In a dispersive medium like an atmosphere, the refractive index is a function of frequency. And it is well described in references, "WAVES", Berkeley physics course, vol. 3, by F. S. Crawford, Jr., McGraw-hill book company, 1968. "Classical Electrodynamics", $2^{nd}$ edition, Chapter 7, by John D. Jackson, John Wiley & Sons, Inc., 1975. "Lectures on Physics", Vol. 1, Chapter 31, by Feynman, Leighton, Sands, Addison-Wesley Publishing Co. The reflected traveling light beam spreads as the traveling distance increases, as shown by the graphical representation in FIG. 15. The observed color of the display unit of FIG. 14 becomes mixed colors of three primary colors of Red, Green, and Blue at distance further than "2R". It is termed "far field observation" if the distance is larger than the separation of light beam sources which is "2R". Near and Far field detector concepts are also well explained in reference, "WAVES", Berkeley physics course, vol. 3, Chapter 9, by F. S. Crawford, Jr., McGraw-hill book company, 1968. Therefore by adjusting amount of reflected light intensity for each sphere 14, as described for what is shown in FIG. 6, one can obtain a desired color from one display unit 26 of FIG. 14 at far field observation due to mixing of three primary colors and the dispersion of traveling light beam in an atmosphere.

Figure 16:
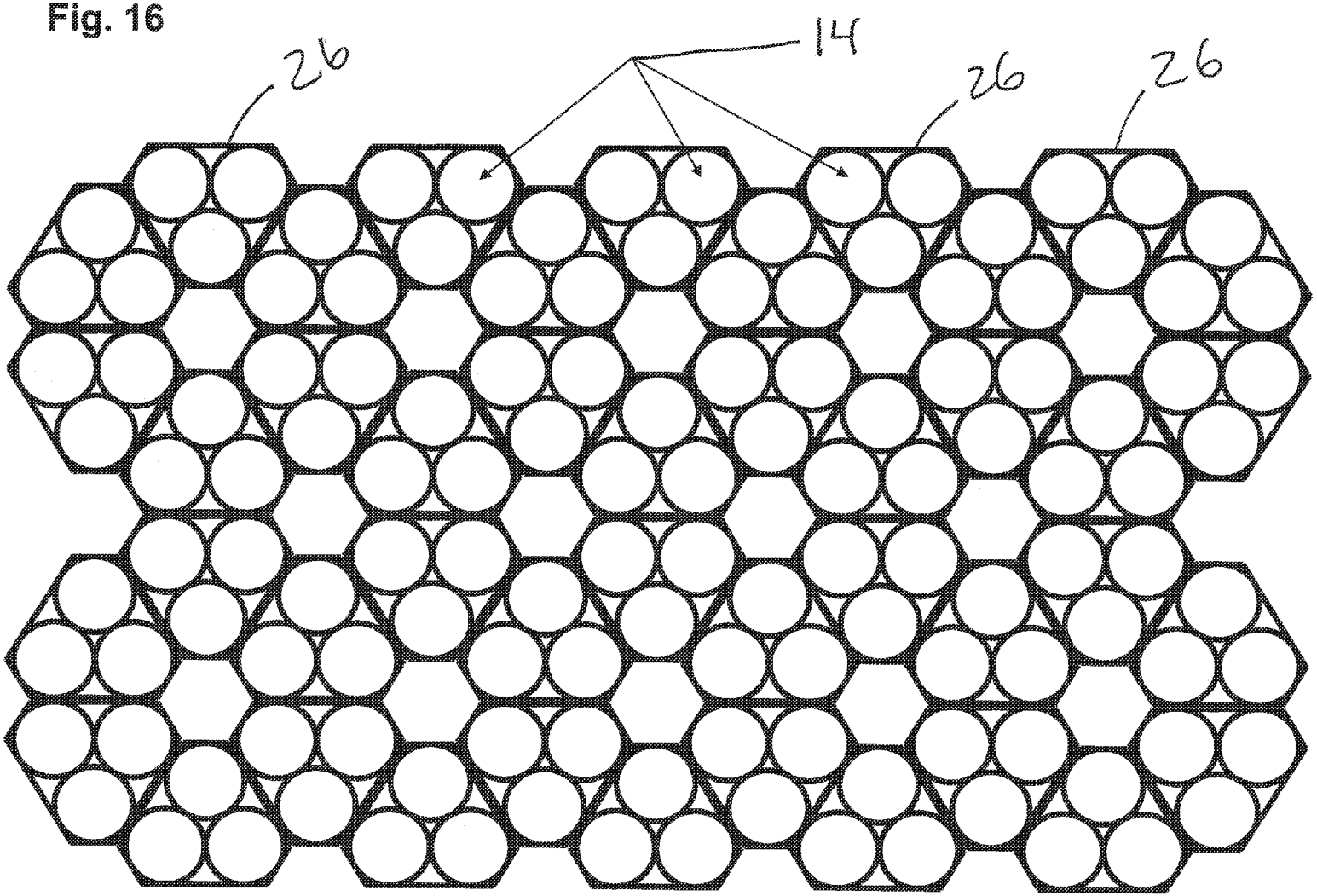
FIG. 16 is a schematic of a display according to the present invention.
Figure 17:
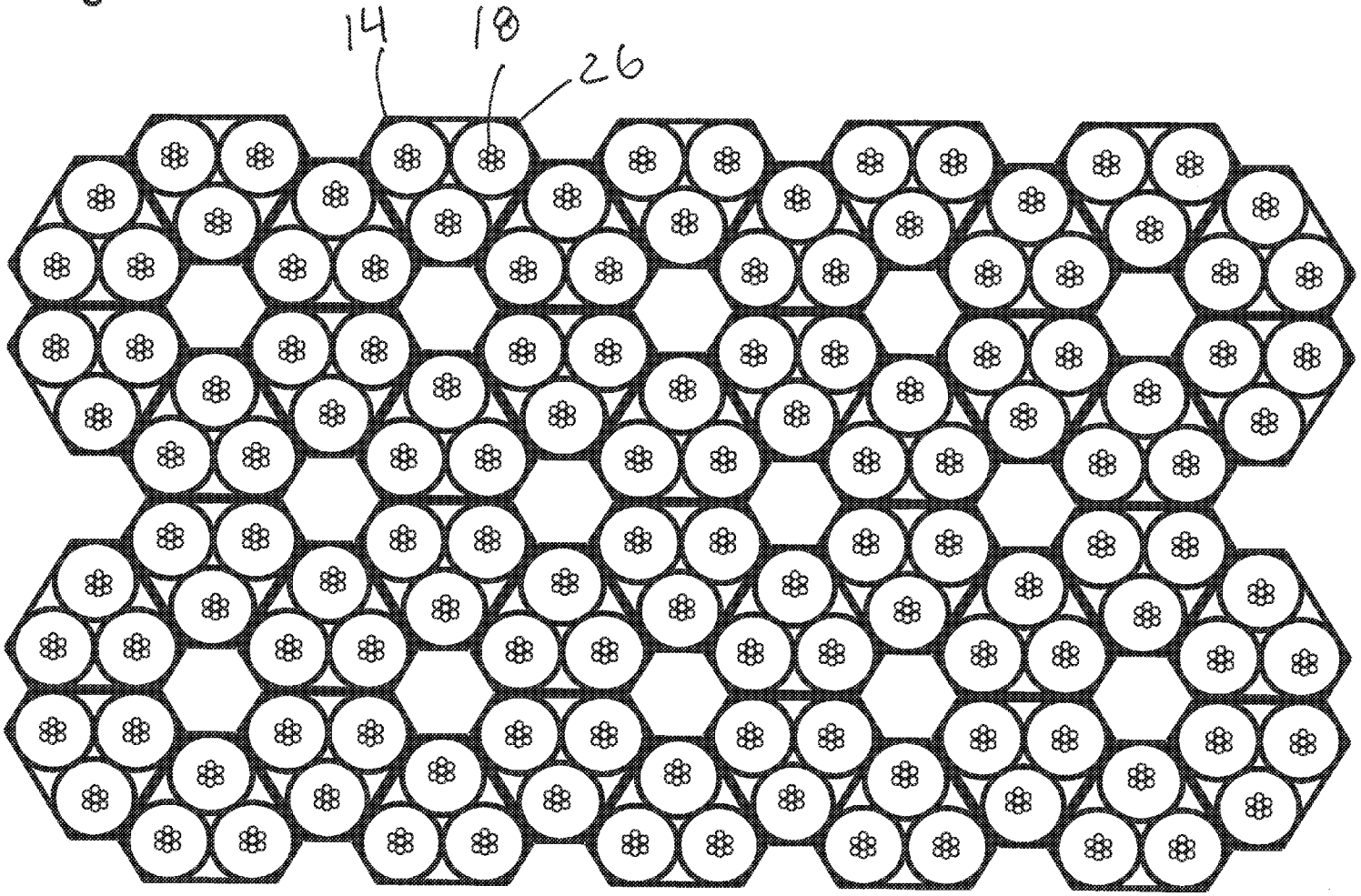
FIG. 17 is a schematic of a display according to the present invention.
Figure 18:
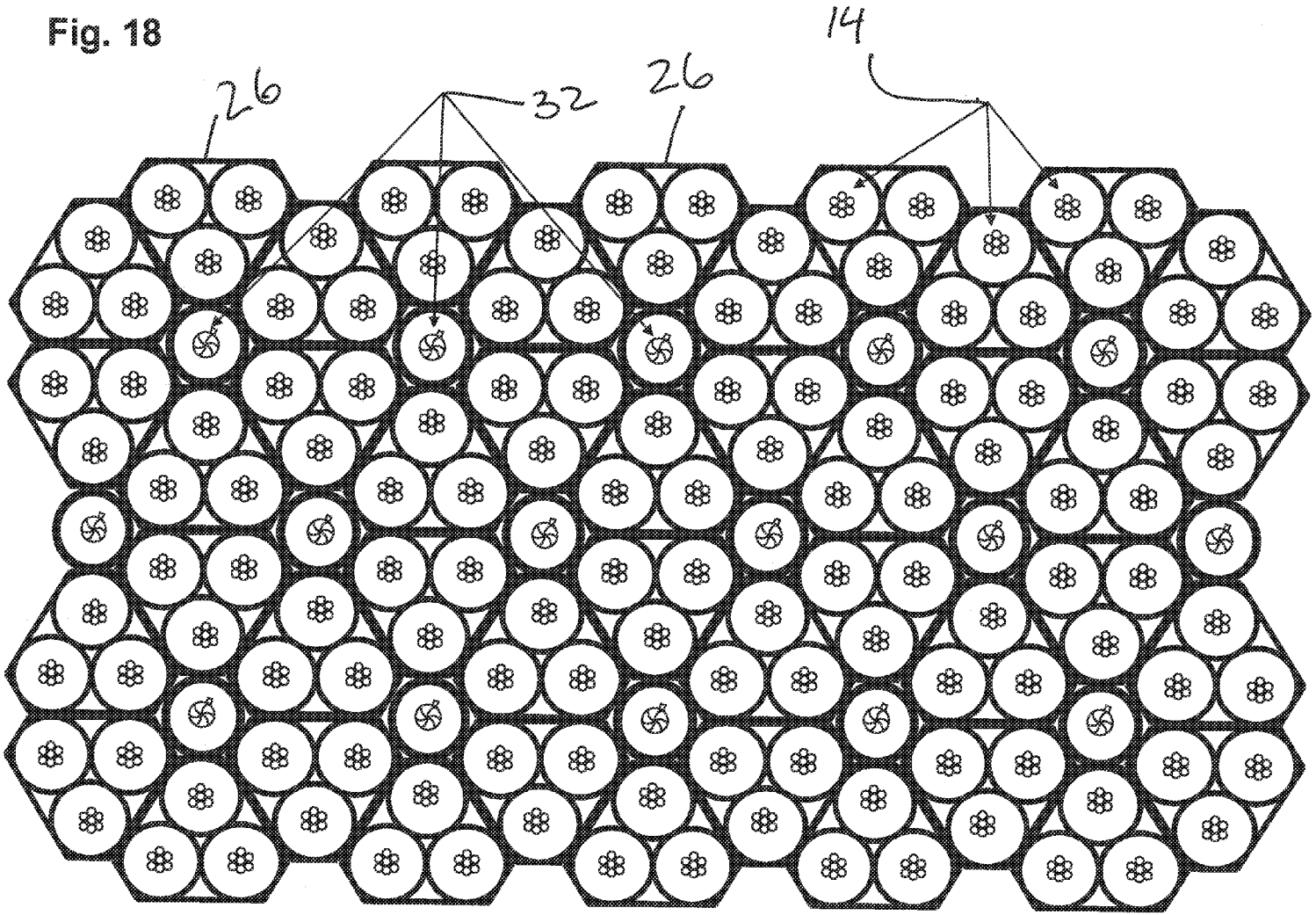
FIG. 18 is a schematic of a display according to the present invention.
Figure 27:
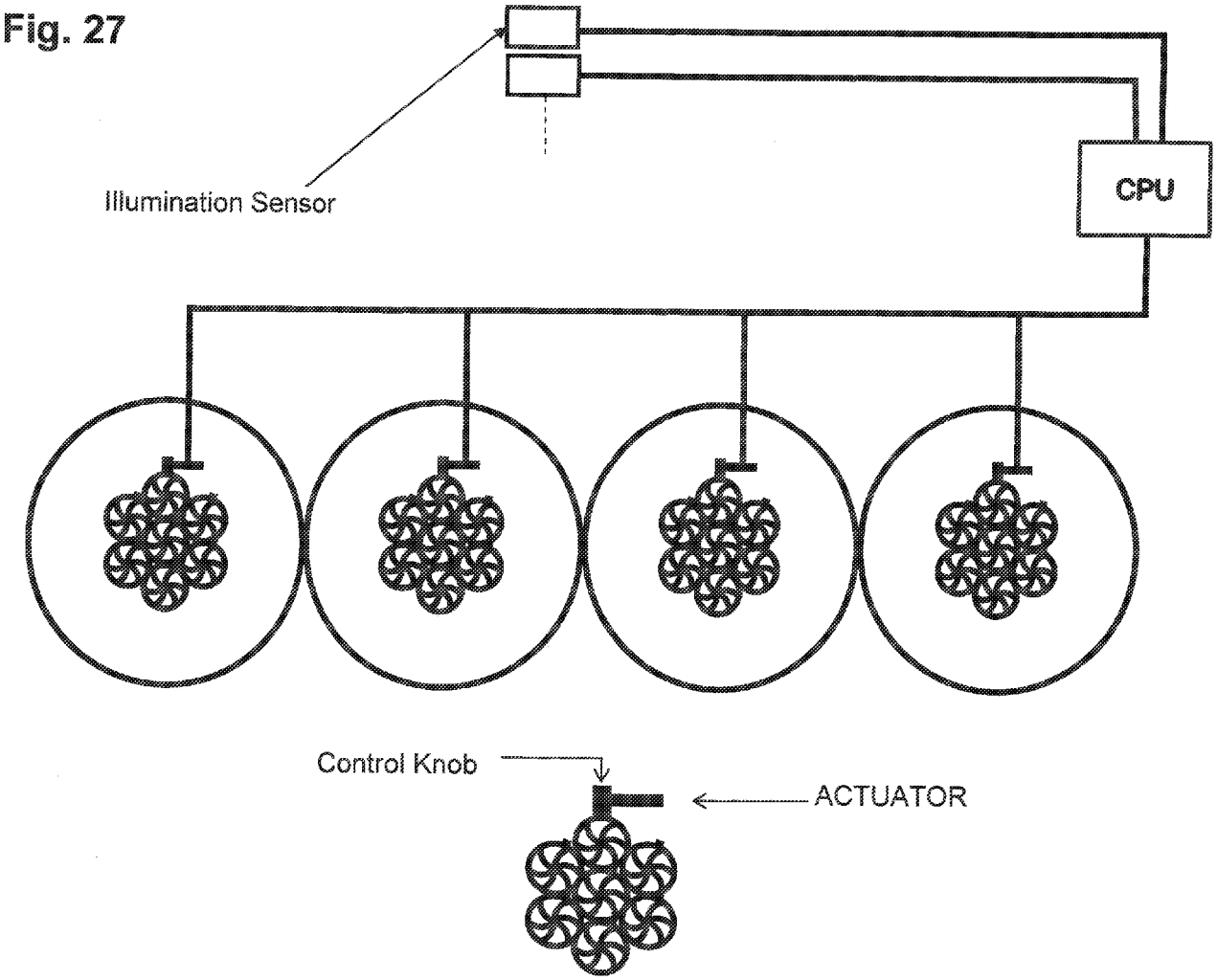
FIG. 27 is a schematic of a control mechanism according to the present invention.

FIG. 16 shows the front view of a display made up of multiple the display units 26 having three spheres 14 with the reflecting three primary colored concave aperture iris diaphragms 18 shown in FIG. 14 for each sphere 14. The size of display can be made from (1 Cm)×(1 Cm) to ($1\times10^3$ Cm)×($1\times10^3$ Cm) by choosing the size of spheres 14 as well as numbers of display units 26. For one interesting application, the whole or part of building including outside walls and ceilings, and inside partitions, could be constructed by using the display units 26 to form the display. It is possible since the oxide materials like glass are tough and durable and also have good thermal insulation properties. The illumination unit shown in FIG. 6 can be incorporated as part of the display to allow and control illumination inside a building automatically according to the pre-set condition as shown in FIG. 27. FIG. 17 shows the rear view of display shown in FIG. 16. Note, that seven three primary colored reflecting concave aperture iris diaphragms 18 are located at the focal point area of each sphere 14. FIG. 18 shows the rear view of the display having a mixture of display units 26 of FIG. 14 and illumination units of FIG. 6. The illumination inside building can be obtained partially by the transmitted light through the display unit 26, however, the transmitted light cannot be controlled for an illumination only, since the main role of the display unit 26 is the presentation of pictures and messages on the outside of a building. Therefore, the main contribution to the pre-set illumination condition inside the building would be by the automatically controlled illumination units of FIG. 6, which complement the varying contribution from a display unit 26 in real time. Note, that the radius of sphere 14 of the display unit 26 and the illumination unit can be different. The radius of spheres 14 for the illumination unit 32 can be chosen to fit into the open space among the display units 26 as shown in FIG. 18. Also note, that the aperture iris diaphragm 18 of the illumination unit is one located at the focal point area. The size of the display with illumination units can be designed from (1 Cm)×(1 Cm) to ($1\times10^3$ Cm)×($1\times10^3$ Cm), by choosing the radius of spheres 14 as well as number of display units 26 and illumination units. The whole or part of building including outside walls and ceilings, and inside partitions and walls, could be constructed by using the display units 26 along with illumination units. It is possible since the oxide materials like glass is tough and durable and has a good thermal insulation property. Most of all, glass is readily available and low cost. The display with display units 26 and illumination units can be utilized for both outside presentation and inside illumination in building. The presentation on the display can be programmed and controlled by CPU in real time. The illumination in building can be adjusted independently and automatically according to the pre-set lighting condition in real time by CPU also as shown in FIG. 27. The characteristic of light beam for illumination is same as that of incoming source light of the natural sun or artificial such as LED light, since it is transmitted light beam property through the sphere 14 and the opening 24 of the concave iris diaphragm 18.

Figure 19:
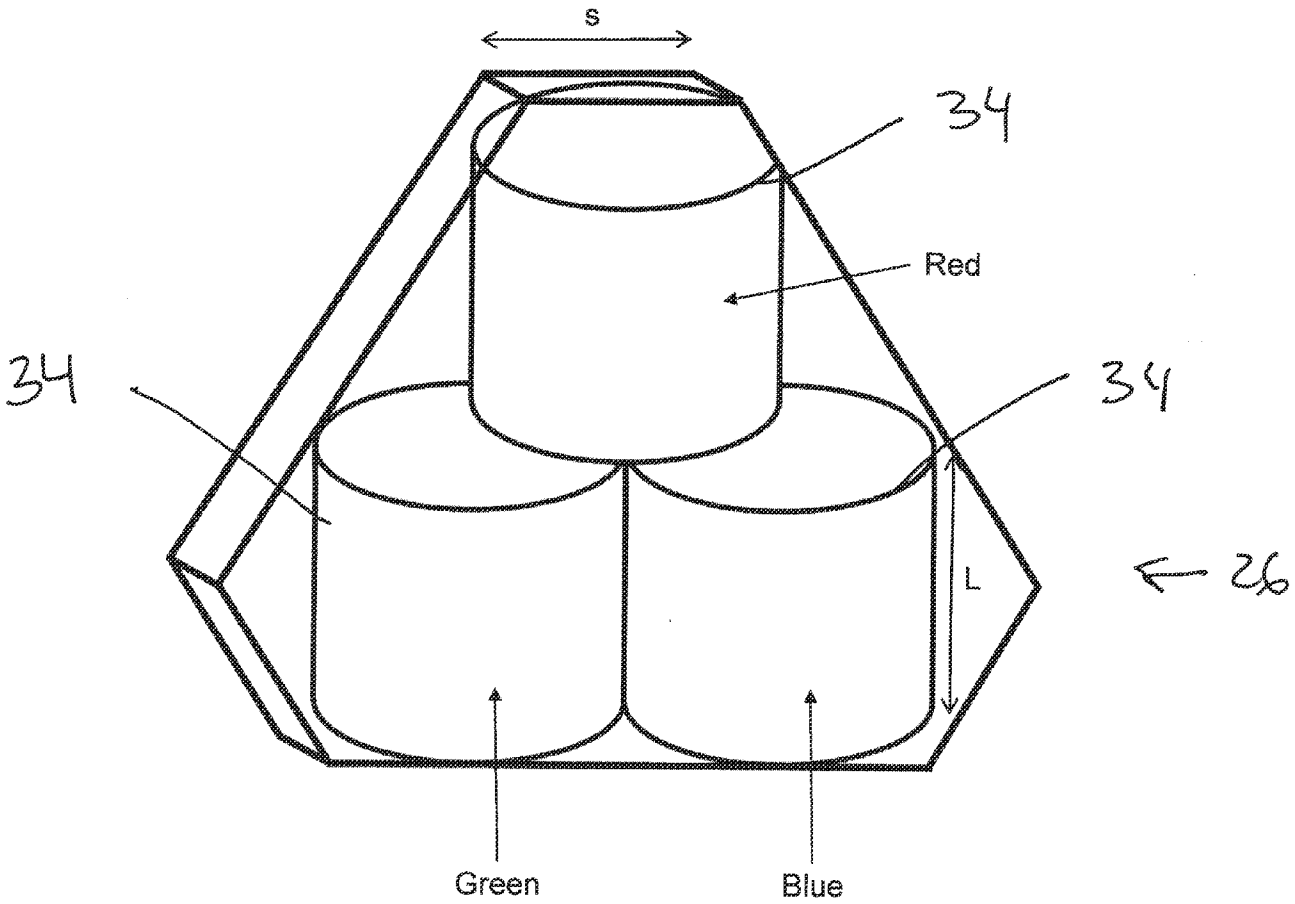
FIG. 19 is a schematic of a display unit according to the present invention.
Figure 20:
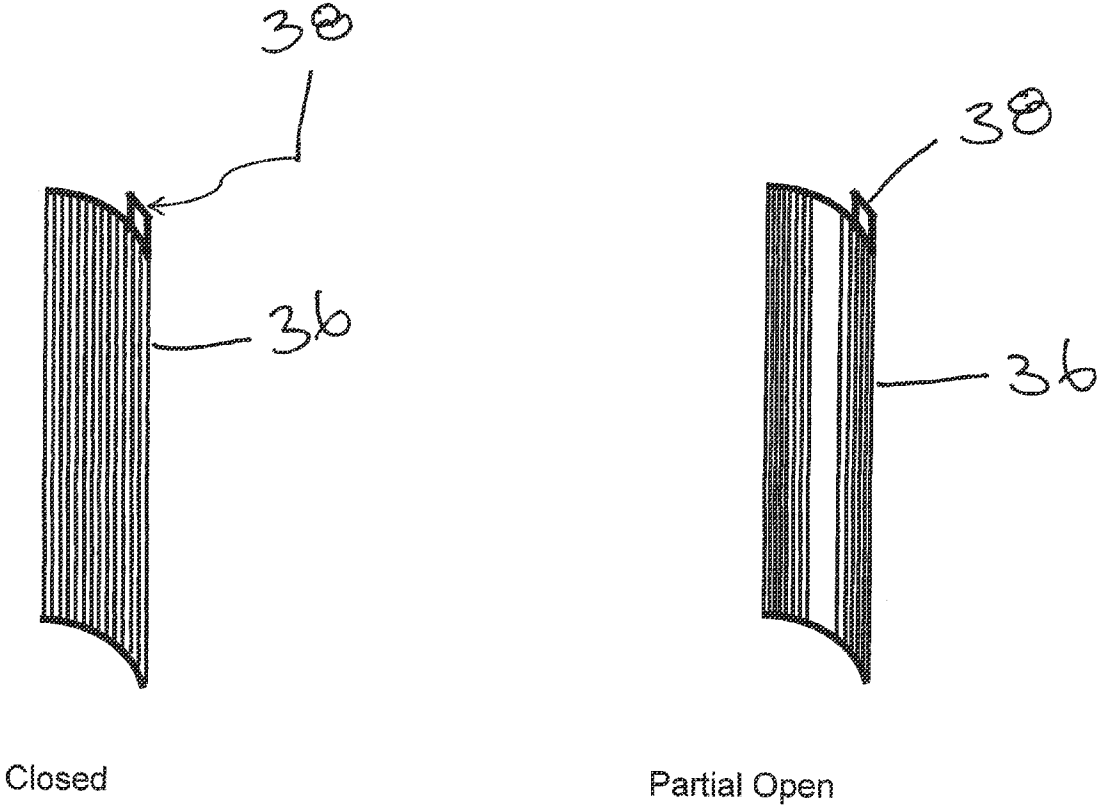
FIG. 20 is a schematic of a concave aperture iris diaphragm according to the present invention.
Figure 21:
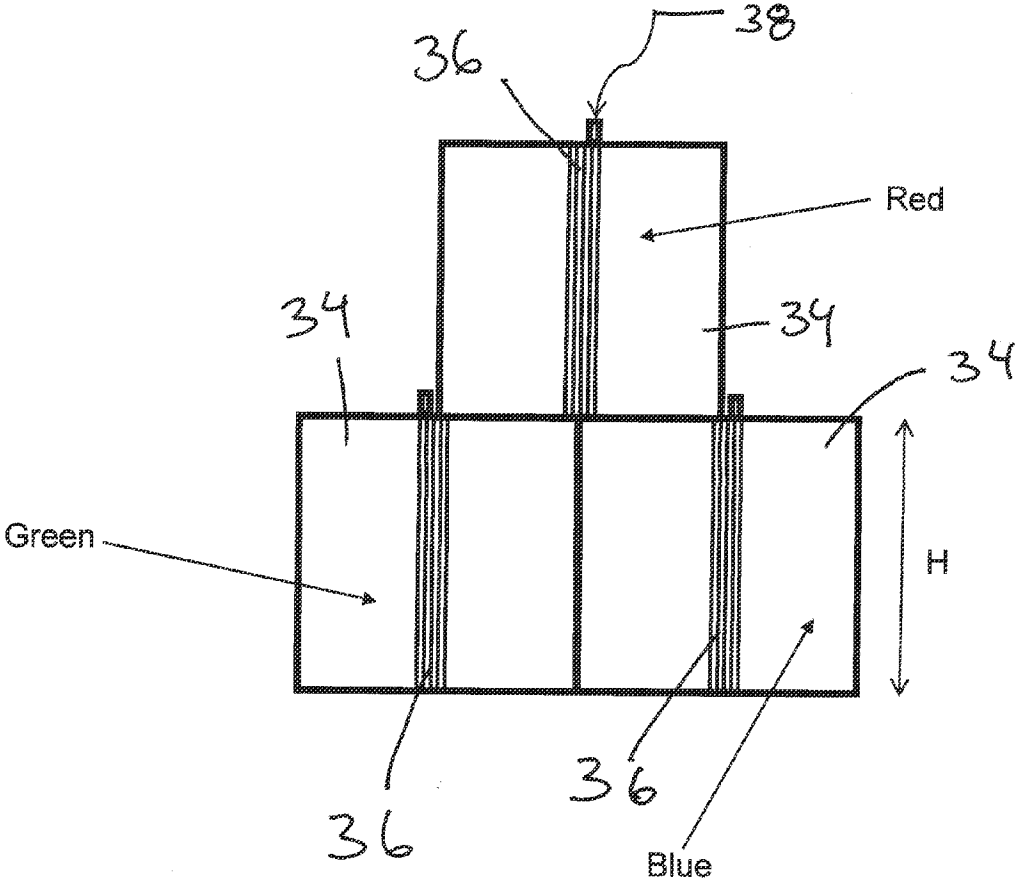
FIG. 21 is a schematic of concave aperture iris diaphragms on a transparent shape according to the present invention.

FIG. 19 shows the 3D view of the display unit 26 using three transparent cylinders 34 with one of the three primary colors of Red, Green and Blue as part of reflecting aperture iris diaphragms 36 on the cylinders 34. The cylinders 34 are used instead of the spheres 14 shown in FIG. 8. The reflecting aperture iris diaphragms 36 for a cylinder 34 are shown in FIG. 20. The reflecting aperture iris diaphragms 36 form a focal line when using cylinders 34 instead of a focal point formed when using the sphere 14 of FIG. 5. The unit box 28 of the display unit 26 using three cylinders 34 can be similar in size and configuration to that of three spheres 14. The size of cylinder 34 can be chosen according to a specific application of the display. The length, L, can be chosen from 1 Cm to $1\times10^2$ Cm, for an instance. FIG. 20 shows the concave reflecting aperture iris diaphragm 36 for the cylinder 34. It can open and operate like Venetian Blinds with a control knob 38. FIG. 21 shows the rear view of FIG. 19. Note, the concave reflecting aperture iris diaphragms 36 are located at focal line area of each cylinder 34.

Figure 22:
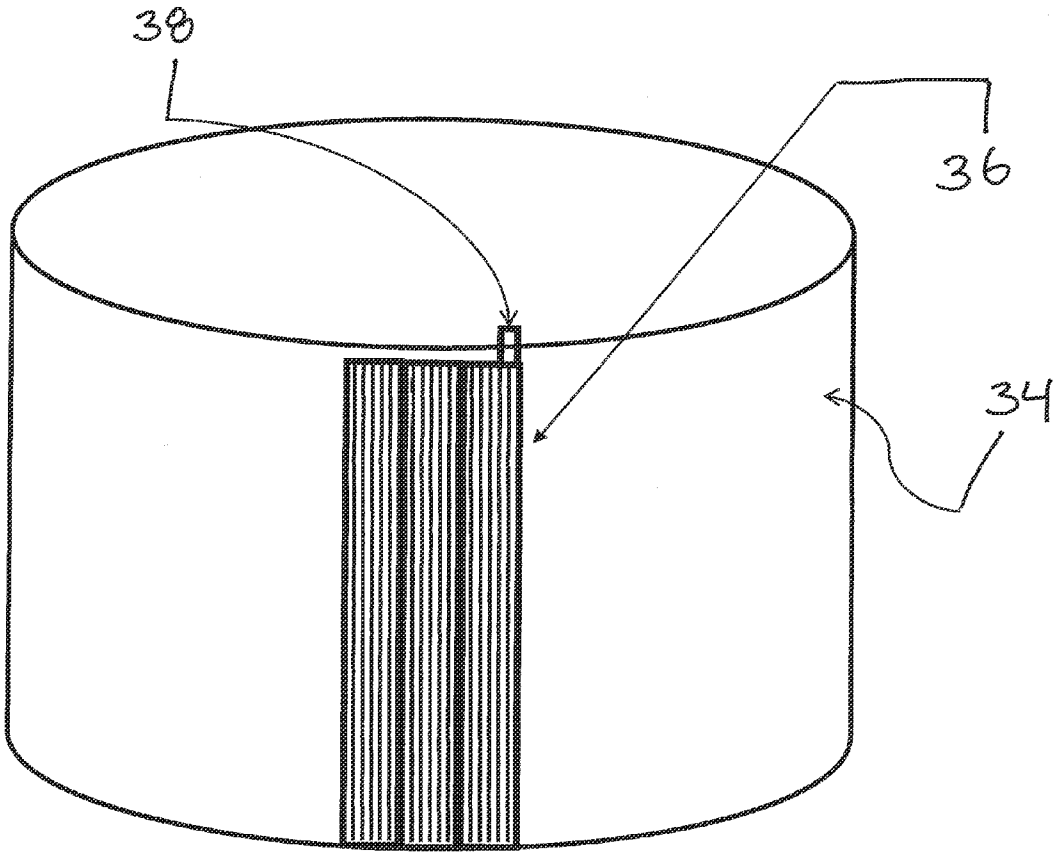
FIG. 22 is a schematic of concave aperture iris diaphragms on a transparent shape according to the present invention.
Figure 23:
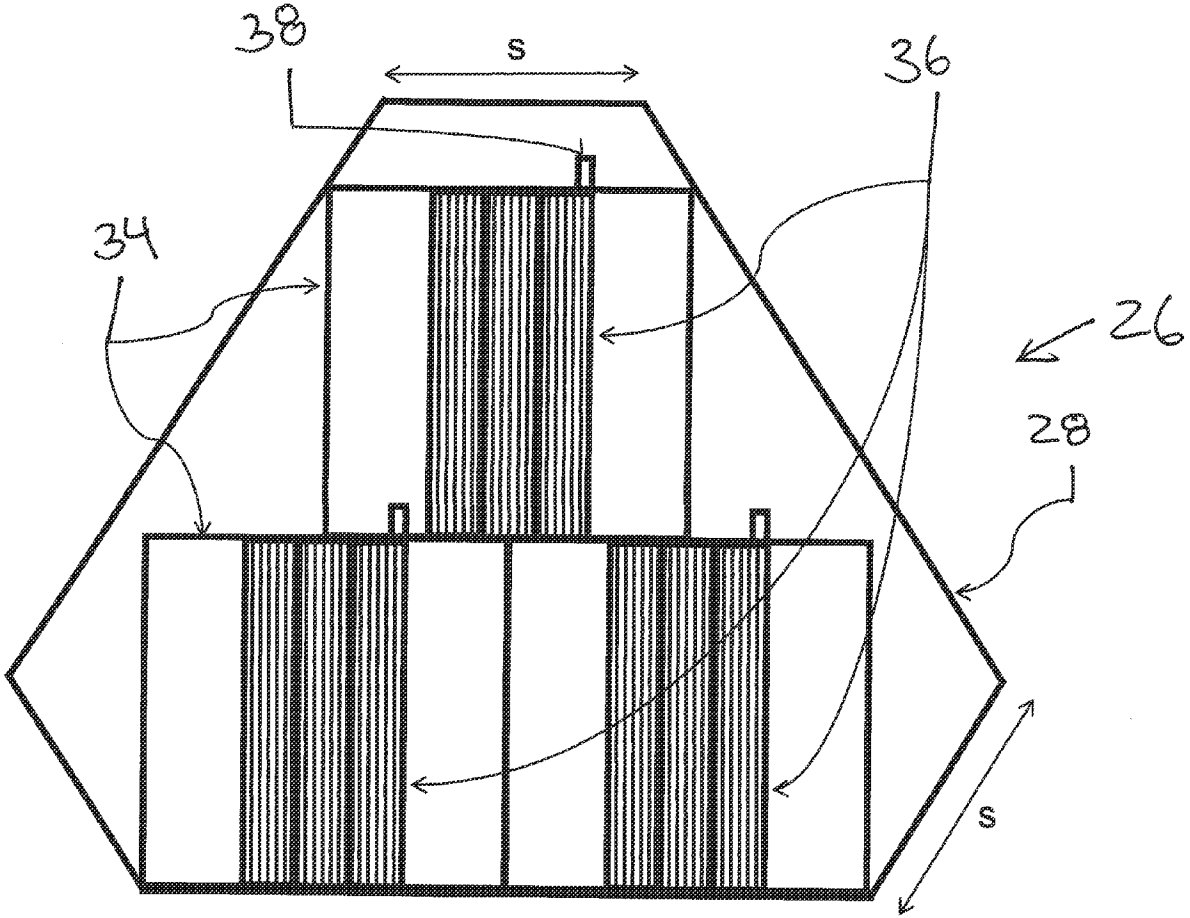
FIG. 23 is a schematic of concave aperture iris diaphragms on a transparent shape according to the present invention.
Figure 24:
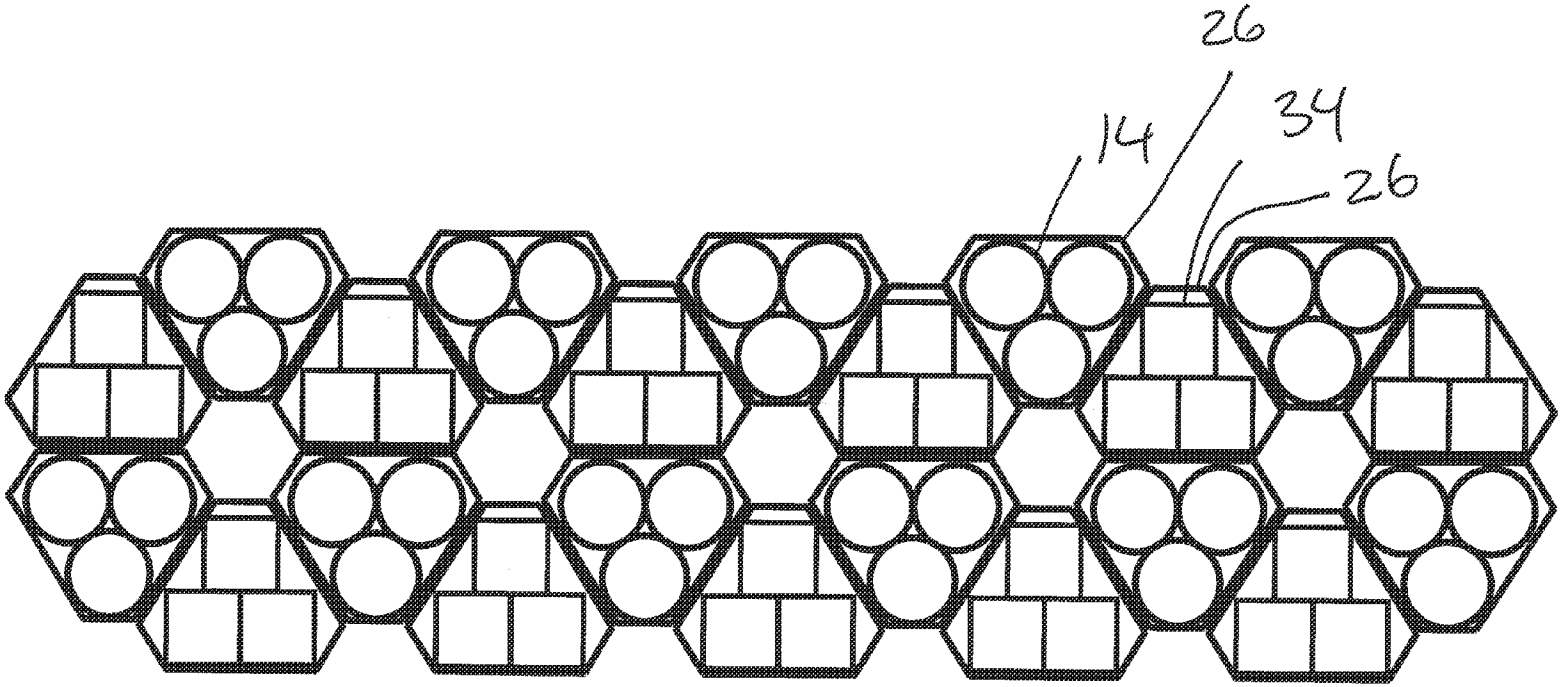
FIG. 24 is a schematic of a display unit according to the present invention.
Figure 25:
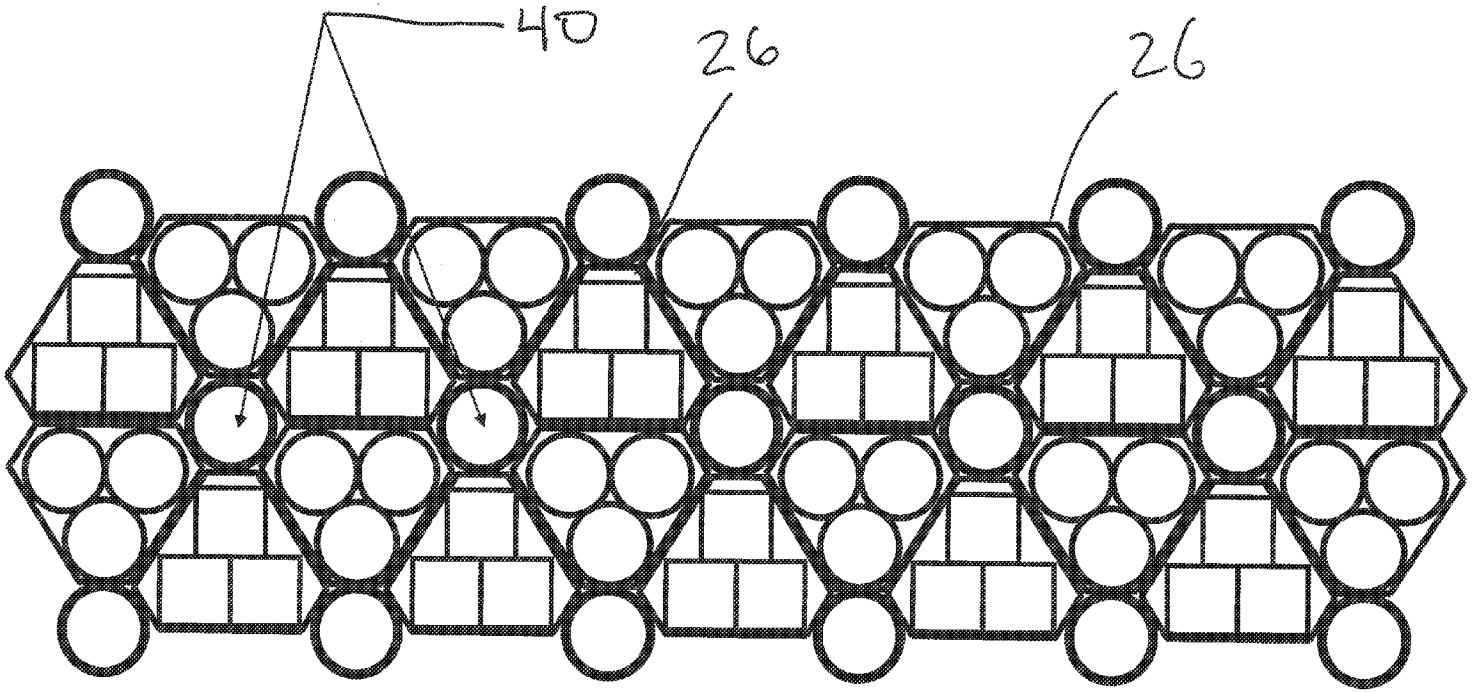
FIG. 25 is a schematic of a display unit according to the present invention.

FIG. 22 shows the rear view of the cylinder 34 with three reflecting concave aperture iris diaphragms 36 located at the corresponding focal line areas for three different incoming light beams. For a cylindrical transparent lens, the angle along the horizontal direction could be only matter, since the other direction is already taken care of. It can be also the basic construction unit for a display with illumination units for the walls and ceilings of the buildings in city. FIG. 23 shows the rear view of the display unit with the three cylinders 34 of FIG. 19. The cylinders 34 of FIG. 23 include the corresponding primary colors reflecting concave aperture iris diaphragms 36 located at focal line areas of each cylinder 34. The display unit 26 of FIG. 23 can also be used as the basic construction unit for display with illumination units as walls and ceilings of the buildings. FIG. 24 shows the display with a mixture of two types of the display unit 26 having the spheres 14 and the cylinders 34. FIG. 25 shows the display of FIG. 24 with illumination units 40, including both types of the display unit 26 with the illumination unit 40 for both outside display presentation and inside illumination of a building.

Figure 26:
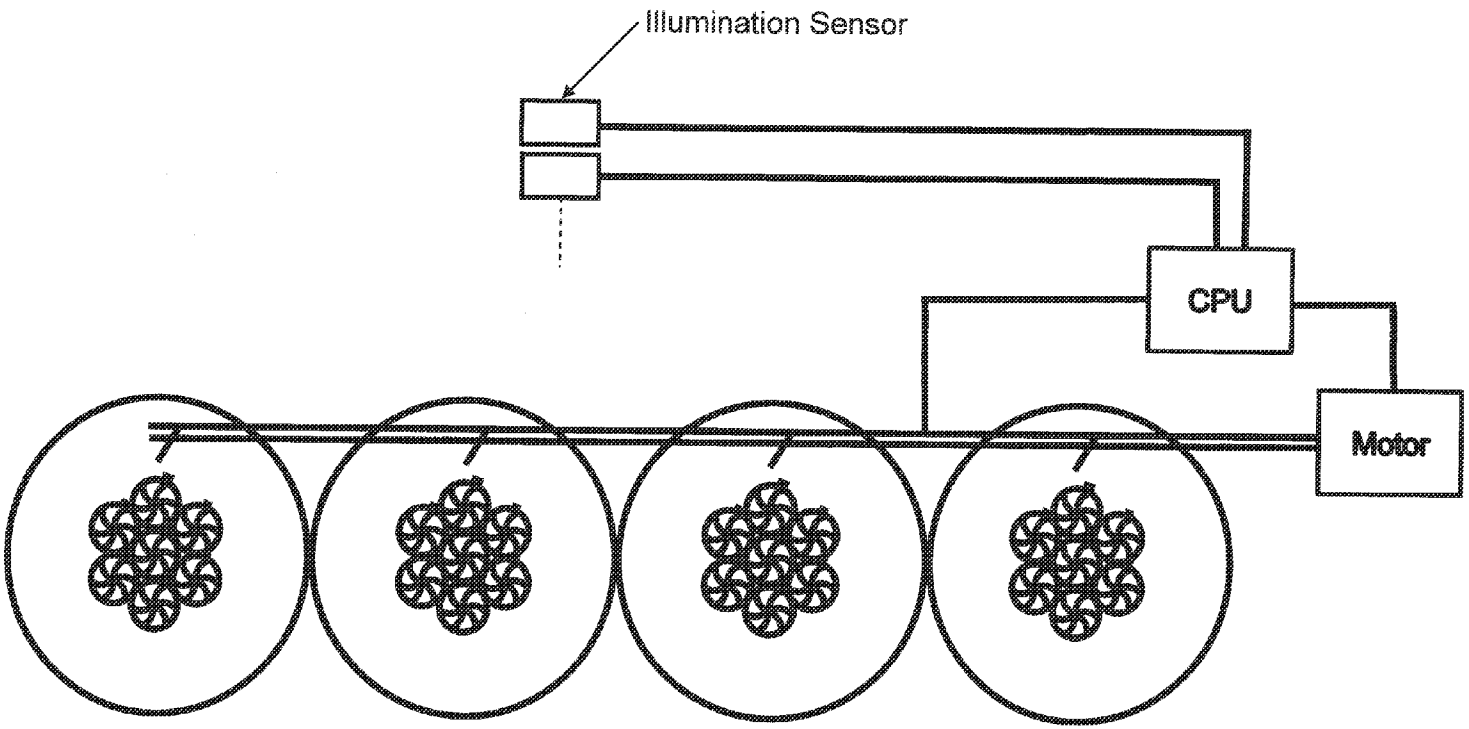
FIG. 26 is a schematic of a control mechanism according to the present invention.

FIG. 26 shows a control mechanism for operation of the reflecting iris aperture diaphragms 18 of the display by using the control knobs. The control knobs of reflecting iris aperture diaphragms 18 are operated by a motor, which is controlled by a CPU. The programmed presentation shown on the display can be coded and delivered from CPU to the motor in real time. The illumination in building can be adjusted independently and automatically by responding to the pre-set lighting conditions controlled by the CPU and motor. FIG. 26 show illumination sensors installed in a building to output signals of the amount of incoming light which is relayed to the CPU in real time. FIG. 27 shows the control mechanism similar to FIG. 26 for reflecting aperture iris diaphragm 18 of display with illumination units by using the control knobs. Actuators are used to control each control knob on individual reflecting aperture iris diaphragm 18 instead of a motor. Each actuator is controlled by CPU. The power for actuators can be supplied by the CPU commanding signal cable or can be supplied from the independent source on each actuator.

The presentation shown on the display can be programmed and controlled by the CPU in real time. The illumination in building can be adjusted independently and automatically according to the pre-set lighting conditions in real time by CPU. The illumination sensors could be installed each desired room in building and its output signals would be fed to CPU in real time. Each concave aperture iris diaphragm attached to the transparent spheres or cylinders in the display with illumination units of FIG. 18 would be addressed and wired and controlled. The display with illumination units can be designed as various combinations and configurations of the display unit and the illumination unit, along with the sun light or/and artificial light as incoming light sources, for illumination and presentation on the display. The display units and illumination units can be used as a building block for walls and ceilings, like bricks or blocks. This is possible because the display unit and illumination unit can be made of versatile and durable materials such as various types of glass with wide ranges of the refractive index and size "2R". Most importantly glass is low cost and relatively easy material to use as building construction materials. It provides a better way to design the efficient energy management system as part of a building compared to that of walls and ceilings constructed by the opaque bricks.

Radiation thermal energy from sun light through the display with illumination units provides additional options to keep the comfortable temperature inside building during winter. The display with illumination units can be adjusted to create the temperature gradient along the height of building. The cooler air coming into building from the $1^{st}$ floor, is ventilating up to the top of building through an open ventilator along the height at the center of building. The temperature gradient would help ventilation by convection. It is known natural way to cool down inside building in summer. Glass has good thermal property as an insulator, so walls and ceilings made of display with illumination units would provide improved ways to keep inside building cool in summer and warm in winter. This is compared to buildings made of opaque bricks because of additional radiation energy from sun into buildings that can be utilized. Sun light is abundant energy source around us for all year long. Utilizing sun light radiation energy, in addition to using the other sources of energies such as an electric power, to maintain the buildings as comfortable place for living and working provides an additional option for saving overall energy consumption in buildings.

The transparent sphere or cylinder with an active AM OLED reflecting aperture iris diaphragm at the focal point or focal line area can be used as one display unit for display instead of using the display units of FIG. 14 and FIG. 19. An active AM OLED aperture iris diaphragm can be designed as both the reflecting by the chosen color and/or the transparent functions. Sun light can be reflected as well as transmitted according to pre-programmed control signal. The control signal and power for the active AM OLED of the display units can be supplied by similar way as shown in FIG. 27.

While different embodiment of the invention have been described in detail herein, it will be appreciated by those skilled in the art that various modification and alternatives to embodiments could be developed in light of the overall teachings of the disclosure. Accordingly, the particular arrangements are illustrated only and are not limiting as to the scope of the invention that is to be given the full breadth of any and all equivalents thereof.

We claim:

1. A building block comprising:

at least one shape in said building block which includes a sealed volume surrounded by said shape, where said shape includes a transparent front and transparent rear to allow light to pass through said front and said rear and enter into a building partially or fully covered by said building block;

at least one iris aperture diaphragm on said rear of each of said at least one shape which is positioned to let all light pass into the building, each of said at least one iris aperture diaphragm having an adjustable opening to control how much light passes into the building.

2. The building block of claim 1, wherein each of said shape is shaped to collect light in said front and project said light to a focal area at said rear so that most of the light travels through said opening of said at least one iris aperture diaphragm.

3. The building block of claim 1, wherein said at least one iris aperture diaphragm has a reflective face about said adjustable opening such that light that enters said front is reflected back towards said front, said reflective face adjustable with said adjustable opening.

4. The building block of claim 3, wherein said reflective face is of a color such that said reflected light reflects said color out towards said front.

5. The building block of claim 4, wherein there are a first, second and third of said at least one shape and wherein said color of said first is red, wherein said color of said second is green, and wherein said color of said third is blue.

6. The building block of claim 5, wherein a multiple of said building blocks together form a display that can display images.

7. The building block of claim 2, wherein said shape is a sphere and said focal area is a focal point.

8. The building block of claim 2, wherein said shape is a cylinder and said focal area is a focal line.

9. The building block of claim 1, wherein each of said at least one shape includes at least two iris aperture diaphragms on said rear each of said at least one shape.

10. The building block of claim 5, further including controls to open and close each of said iris aperture diaphragm to produce a single color that is reflected back towards a front of said building block.

11. A method of allowing light to enter a building using materials of the building structure, comprising:

constructing a building of at least one building block, where each building block includes at least one transparent shape in the building block which includes a sealed volume surrounded by the shape, where the shape includes a transparent front and transparent rear to allow light to pass through the front and the rear and enter into the building made of the building block, where there is at least one iris aperture diaphragm on the rear of the at least one shape which is positioned to allow the light to pass into the building, the at least one iris aperture diaphragm having an adjustable opening to control how much light passes into the building, where the iris aperture diaphragm has a reflective face about the adjustable opening such that light that enters the front is reflected back towards the front, where the reflective face is adjustable with the adjustable opening; and controlling the size of opening of the adjustable opening to control how light is allowed to pass and how light is reflected back towards the front.

12. The method of claim 11, wherein controlling the amount of light that is allowed into the building also includes controlling how many transparent shapes are in the building block.

13. The method of claim 11, wherein controlling the amount of light that is allowed into the building also includes controlling how many building blocks with the transparent shape are used in constructing the building.

14. A method of allowing displaying an image as part of a building using materials of the building structure, comprising:

constructing a building of at least one building block, where each building block includes at least three transparent shapes in the building block, where each of the shapes includes a sealed volume surrounded by each of the shapes, where each of the shapes includes a transparent front and transparent rear to allow light to pass through the front and the rear, where there is at least one iris aperture diaphragm on the rear of each of the shapes which is positioned to capture the light, each of the at least one iris aperture diaphragms having an adjustable opening to control how much light passes, where each of the iris aperture diaphragms has a reflective face about the adjustable opening such that light that enters the front is reflected back towards the front, where each of the reflective faces is adjustable with the adjustable opening, where each of the reflective faces is of a color such that the reflected light reflects the color out towards the front, where one of the three shapes reflects the color red, where one of the three shapes reflects the color green and where one of the three shapes reflects the color blue;

controlling the size of opening of the adjustable opening to control how much color is reflected back towards the front.

15. The method of claim 14, wherein controlling the image displayed also includes controlling how many building blocks are used.

* * * * *